US010570668B2

(12) United States Patent
Izbinski et al.

(10) Patent No.: US 10,570,668 B2
(45) Date of Patent: Feb. 25, 2020

(54) CUTTING ELEMENTS CONFIGURED TO REDUCE IMPACT DAMAGE AND MITIGATE POLYCRYSTALLINE, SUPERABRASIVE MATERIAL FAILURE EARTH-BORING TOOLS INCLUDING SUCH CUTTING ELEMENTS, AND RELATED METHODS

(71) Applicant: Baker Hughes, a GE company, LLC, Houston, TX (US)

(72) Inventors: Konrad Thomas Izbinski, The Woodlands, TX (US); Richard Wayne Borge, Houston, TX (US); Nicholas J. Lyons, Houston, TX (US); Xu Huang, Spring, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 0 days.

(21) Appl. No.: 16/047,819

(22) Filed: Jul. 27, 2018

(65) Prior Publication Data

US 2020/0032589 A1 Jan. 30, 2020

(51) Int. Cl.
*E21B 10/573* (2006.01)
*E21B 10/00* (2006.01)

(52) U.S. Cl.
CPC ..... *E21B 10/5735* (2013.01); *E21B 10/006* (2013.01)

(58) Field of Classification Search
CPC ..... E21B 10/5735; E21B 10/006; E21B 2010/565; E21B 2010/561; E21B 10/46
See application file for complete search history.

(56) References Cited

U.S. PATENT DOCUMENTS 4,987,800 A 1/1991 Gasan et al.
4,989,578 A 2/1991 Lebourg
(Continued)

FOREIGN PATENT DOCUMENTS

EP 0572761 A1 12/1993
EP 0893572 B1 12/2003
(Continued)

OTHER PUBLICATIONS

International Search Report for International Application No. PCT/US2019/043378 dated Nov. 12, 2019, 5 pages.
(Continued)

*Primary Examiner* — James G Sayre
(74) *Attorney, Agent, or Firm* — TraskBritt

(57) ABSTRACT

A cutting element for an earth-boring tool includes a substrate and a polycrystalline, superabrasive material secured to an end of the substrate. The polycrystalline, superabrasive material includes a curved, stress-reduction feature located at least on the first transition surface. The cutting element includes at least one recess defined in the curved, stress-reduction feature of the polycrystalline, superabrasive material. The at least one recess includes sidewalls intersecting with a front surface of the stress-reduction feature of the polycrystalline, superabrasive material and extending to a base wall within the polycrystalline, superabrasive material. The curved, stress-reduction feature includes an undulating edge formed proximate a peripheral edge of the polycrystalline, superabrasive material and a waveform extending from the undulating edge toward the center longitudinal axis of the cutting element.

18 Claims, 12 Drawing Sheets

(56) References Cited

U.S. PATENT DOCUMENTS

| | | | |
|---|---|---|---|
| 5,054,246 | A | 10/1991 | Phaal et al. |
| 5,172,778 | A | 12/1992 | Tibbitts et al. |
| 5,437,343 | A | 8/1995 | Cooley et al. |
| 5,709,279 | A | 1/1998 | Dennis |
| 6,045,440 | A | 4/2000 | Johnson et al. |
| 6,065,554 | A | 5/2000 | Taylor et al. |
| 6,196,340 | B1 | 3/2001 | Jensen et al. |
| 6,244,365 | B1 | 6/2001 | Southland |
| 6,510,910 | B2 | 1/2003 | Eyre et al. |
| 6,527,069 | B1 | 3/2003 | Meiners et al. |
| 6,550,556 | B2 | 4/2003 | Middlemiss et al. |
| 6,935,444 | B2 | 8/2005 | Lund et al. |
| 7,475,744 | B2 | 1/2009 | Pope |
| 7,726,420 | B2 | 6/2010 | Shen et al. |
| 7,740,090 | B2 | 6/2010 | Shen et al. |
| 8,037,951 | B2 | 10/2011 | Shen et al. |
| 8,353,370 | B2 | 1/2013 | Bellin et al. |
| 8,499,860 | B2 | 8/2013 | Shen et al. |
| 8,684,112 | B2 | 4/2014 | Digiovanni et al. |
| 9,062,505 | B2 | 6/2015 | Chapman et al. |
| 9,103,174 | B2 | 8/2015 | Digiovanni |
| 9,145,743 | B2 | 9/2015 | Shen et al. |
| 9,243,452 | B2 | 1/2016 | Digiovanni et al. |
| 9,404,310 | B1 | 8/2016 | Sani et al. |
| 9,428,966 | B2 | 8/2016 | Patel et al. |
| 9,702,198 | B1 | 7/2017 | Topham |
| 2006/0157286 | A1 | 7/2006 | Pope |
| 2006/0219439 | A1 | 10/2006 | Shen et al. |
| 2007/0079995 | A1 | 4/2007 | McClain et al. |
| 2008/0205804 | A1 | 8/2008 | Jeng |
| 2008/0236900 | A1 | 10/2008 | Cooley et al. |
| 2009/0057031 | A1 | 3/2009 | Patel et al. |
| 2010/0084198 | A1 | 4/2010 | Durairajan et al. |
| 2010/0288564 | A1 | 11/2010 | Dovalina et al. |
| 2011/0031031 | A1 | 2/2011 | Vempati et al. |
| 2011/0088950 | A1 | 4/2011 | Scott et al. |
| 2011/0155472 | A1 | 6/2011 | Lyons et al. |
| 2011/0171414 | A1* | 7/2011 | Sreshta ..... B22F 7/06 428/64.1 |
| 2011/0259642 | A1 | 10/2011 | Digiovanni et al. |
| 2011/0286810 | A1 | 11/2011 | Lancaster et al. |
| 2012/0247834 | A1 | 10/2012 | Buxbaum et al. |
| 2012/0325563 | A1 | 12/2012 | Scott et al. |
| 2013/0068534 | A1 | 3/2013 | Digiovanni et al. |
| 2013/0068537 | A1 | 3/2013 | Digiovanni |
| 2013/0068538 | A1 | 3/2013 | Digiovanni et al. |
| 2014/0041948 | A1 | 2/2014 | Shen et al. |
| 2014/0238753 | A1 | 8/2014 | Nelms et al. |
| 2014/0246253 | A1 | 9/2014 | Patel et al. |
| 2015/0047913 | A1 | 2/2015 | Durairajan et al. |
| 2015/0259988 | A1 | 9/2015 | Chen et al. |
| 2015/0285007 | A1 | 10/2015 | Stockey et al. |
| 2016/0069140 | A1 | 3/2016 | Patel et al. |
| 2016/0265285 | A1 | 9/2016 | Stockey et al. |
| 2018/0320450 | A1* | 11/2018 | Borge ..... E21B 10/5676 |
| 2019/0071933 | A1 | 3/2019 | Gan et al. |

FOREIGN PATENT DOCUMENTS

| | | | |
|---|---|---|---|
| GB | 2369841 | | 12/2004 |
| WO | 97/30263 | A1 | 8/1997 |
| WO | 00/48789 | A1 | 8/2000 |
| WO | 2004/007901 | A1 | 1/2004 |
| WO | 2004/007907 | A1 | 1/2004 |
| WO | 2008/102324 | A1 | 8/2008 |
| WO | 2016/004136 | A1 | 3/2016 |
| WO | 2016/044136 | A1 | 3/2016 |

OTHER PUBLICATIONS

International Written Opinion for International Application No. PCT/US2019/043378 dated Nov. 12, 2019, 7 pages.

International Search Report for International Application No. PCT/US2019/043367 dated Nov. 14, 2019, 5 pages.

International Written Opinion for International Application No. PCT/US2019/043367 dated Nov. 14, 2019, 7 pages.

* cited by examiner

CUTTING ELEMENTS CONFIGURED TO REDUCE IMPACT DAMAGE AND MITIGATE POLYCRYSTALLINE, SUPERABRASIVE MATERIAL FAILURE EARTH-BORING TOOLS INCLUDING SUCH CUTTING ELEMENTS, AND RELATED METHODS

RELATED APPLICATION

The present application is related to co-pending U.S. patent application Ser. No. 16/047,863, "CUTTING ELEMENTS CONFIGURED TO REDUCE IMPACT DAMAGE RELATED TOOLS AND METHODS—ALTERNATE CONFIGURATIONS," filed Jul. 27, 2018, the entire disclosure of which is hereby incorporated herein by this reference. The present application is also related to the subject matter of co-pending U.S. patent application Ser. No. 15/584,943, filed on May 2, 2017. Additionally, the present application is also related to the subject matter of co-pending U.S. patent application Ser. No. 14/656,036, filed on Mar. 12, 2015.

FIELD

This disclosure relates generally to cutting elements for earth-boring tools, to earth-boring tools carrying such cutting elements, and to related methods. More specifically, disclosed embodiments relate to cutting elements for earth-boring tools that may better resist impact damage, induce beneficial stress states within the cutting elements, and improve cooling of the cutting elements.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using a drill bit, such as an earth-boring rotary drill bit. Different types of earth-boring rotary drill bits are known in the art, including fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end that extends into the wellbore from the surface of earth above the subterranean formations being drilled. Various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may include, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore. The downhole motor may be operated with or without drill string rotation.

Cutting elements used in earth boring tools often include polycrystalline diamond compact (often referred to as "PDC") cutting elements, which are cutting elements that include so-called "tables" of a polycrystalline diamond material mounted to supporting substrates and presenting a cutting face for engaging a subterranean formation. Polycrystalline diamond (often referred to as "PCD") material is material that includes inter-bonded grains or crystals of diamond material. In other words, PCD material includes direct, intergranular bonds between the grains or crystals of diamond material.

Cutting elements are typically mounted on body a drill bit by brazing. The drill bit body is formed with recesses therein, commonly termed "pockets," for receiving a substantial portion of each cutting element in a manner that presents the PCD layer at an appropriate back rake and side rake angle, facing in the direction of intended bit rotation, for cutting in accordance with the drill bit design. In such cases, a brazing compound is applied between the surface of the substrate of the cutting element and the surface of the recess on the bit body in which the cutting element is received. The cutting elements are installed in their respective recesses in the bit body, and heat is applied to each cutting element via a torch to raise the temperature to a point high enough to braze the cutting elements to the bit body in a fixed position but not so high as to damage the PCD layer. The cutting elements are conventionally fixed in place, such as, for example, by brazing the cutting elements within pockets formed in the rotationally leading portions of the blades. Because formation material removal exposes the formation-engaging portions of the cutting tables to impacts against the subterranean formations, the cutting elements may chip, which dulls the impacted portion of the cutting element or even spall, resulting in loss of substantial portions of the table. Continued use may wear away that portion of the cutting table entirely, leaving a completely dull surface that is ineffective at removing earth material.

Spalls and cracks in the conventional PDC table of cutting elements are a common problem when drilling with such cutting structures. Spalling in PDC tables of such cutting elements can greatly reduce the effectiveness of drill bits and other drilling tools and often renders a PDC table unusable such that the cutting element including the PDC table must be completely replaced before the drill bit or other drilling tool is employed in another drilling operation

BRIEF SUMMARY

Some embodiments of the present disclosure include a cutting element for an earth-boring tool. The cutting element may include a substrate and a polycrystalline, superabrasive material secured to an end of the substrate. The polycrystalline, superabrasive material may include a curved, stress-reduction feature formed in a cutting face of the polycrystalline, superabrasive material. The cutting element further includes at least one recess defined in the curved, stress-reduction feature of the polycrystalline, superabrasive material and comprising: sidewalls intersecting with a front surface of the curved, stress-reduction feature of the polycrystalline, superabrasive material and extending to a base wall within the polycrystalline, superabrasive material.

Further embodiments of the present disclosure include an earth-boring tool. The earth-boring tool may include a body and a cutting element secured to the body. The cutting element may include a substrate and a polycrystalline, superabrasive material secured to an end of the substrate. The polycrystalline, superabrasive material may include a curved, stress-reduction feature formed in a cutting face of the polycrystalline, superabrasive material. The curved, stress-reduction feature may include an undulating edge formed proximate an outer peripheral edge of the polycrystalline, superabrasive material and a waveform extending from the undulating edge toward a center longitudinal axis of the cutting element. The cutting element may further include at least one recess defined in the waveform of the curved, stress-reduction feature of the polycrystalline, superabrasive material and comprising: sidewalls intersecting with a front surface of the waveform of the curved, stress-reduction feature of the polycrystalline, superabrasive material and extending to a base wall within the polycrystalline, superabrasive material.

Additional embodiments of the present disclosure include a method of forming a cutting element for an earth-boring tool. The method may include attaching a polycrystalline, superabrasive material to a substrate, forming a curved, stress-reduction feature in a cutting face of the polycrystalline, superabrasive material, the curved, stress-reduction feature including an undulating edge formed proximate an outer peripheral edge of the polycrystalline, superabrasive material and a waveform extending from the undulating edge toward a center longitudinal axis of the substrate, and forming at least one recess in the curved, stress-reduction feature of the polycrystalline, superabrasive material, the at least one recess comprising: sidewalls intersecting with a front surface of the curved, stress-reduction feature of the polycrystalline, superabrasive material and extending to a base wall within the polycrystalline, superabrasive material.

DETAILED DESCRIPTION

Figure 1:
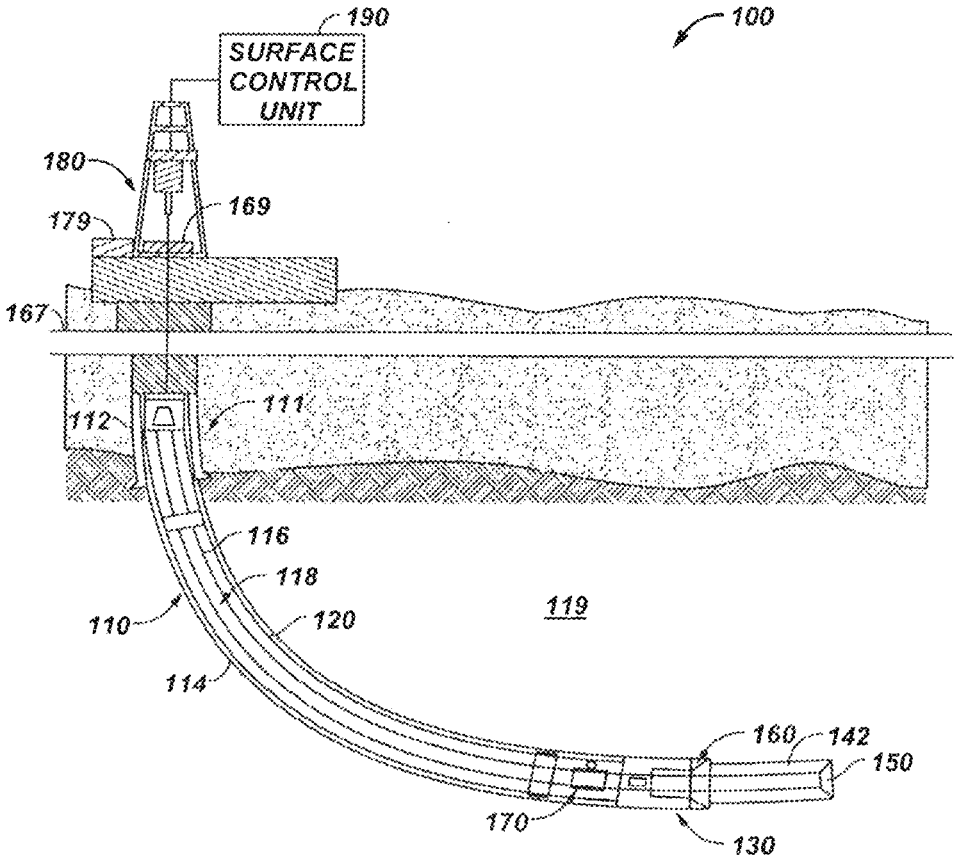
FIG. 1 is a simplified schematic diagram of an example of a drilling system using cutting element assemblies according to one or more embodiments of the present disclosure.

The illustrations presented herein are not actual views of any particular cutting element, tool, or drill string, but are merely idealized representations employed to describe example embodiments of the present disclosure. The following description provides specific details of embodiments of the present disclosure in order to provide a thorough description thereof. However, a person of ordinary skill in the art will understand that the embodiments of the disclosure may be practiced without employing many such specific details. Indeed, the embodiments of the disclosure may be practiced in conjunction with conventional techniques employed in the industry. In addition, the description provided below does not include all elements to form a complete structure or assembly. Only those process acts and structures necessary to understand the embodiments of the disclosure are described in detail below. Additional conventional acts and structures may be used. Also note, any drawings accompanying the application are for illustrative purposes only, and are thus not drawn to scale. Additionally, elements common between figures may have corresponding numerical designations.

As used herein, the terms "comprising," "including," "containing," "characterized by," and grammatical equivalents thereof are inclusive or open-ended terms that do not exclude additional, un-recited elements or method steps, but also include the more restrictive terms "consisting of," "consisting essentially of," and grammatical equivalents thereof.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, the term "configured" refers to a size, shape, material composition, and arrangement of one or more of at least one structure and at least one apparatus facilitating operation of one or more of the structure and the apparatus in a predetermined way.

As used herein, the singular forms following "a," "an," and "the" are intended to include the plural forms as well, unless the context clearly indicates otherwise.

As used herein, the term "and/or" includes any and all combinations of one or more of the associated listed items.

As used herein, spatially relative terms, such as "below," "lower," "bottom," "above," "upper," "top," and the like, may be used for ease of description to describe one element's or feature's relationship to another element(s) or feature(s) as illustrated in the Figures. Unless otherwise specified, the spatially relative terms are intended to encompass different orientations of the materials in addition to the orientation depicted in the Figures.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter).

As used herein, the term "hard material" means and includes any material having a Knoop hardness value of about 1,000 $kg_f/mm^2$ (9,807 MPa) or more. Hard materials include, for example, diamond, cubic boron nitride, boron carbide, tungsten carbide, etc.

As used herein, the term "intergranular bond" means and includes any direct atomic bond (e.g., covalent, metallic, etc.) between atoms in adjacent grains of material.

As used herein, the term "polycrystalline hard material" means and includes any material comprising a plurality of grains or crystals of the material that are bonded directly together by intergranular bonds. The crystal structures of the individual grains of polycrystalline hard material may be randomly oriented in space within the polycrystalline hard material.

As used herein, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide.

As used herein, the term "superabrasive material" means and includes any material having a Knoop hardness value of about 3,000 $Kg_f/mm^2$ (29,420 MPa) or more. Superabrasive materials include, for example, diamond and cubic boron nitride. Superabrasive materials may also be characterized as "superhard" materials.

As used herein, the term "earth-boring tool" means and includes any type of bit or tool used for drilling during the formation or enlargement of a wellbore and includes, for example, rotary drill bits, percussion bits, core bits, eccentric bits, bi-center bits, reamers, mills, drag bits, roller-cone bits, hybrid bits, and other drilling bits and tools known in the art.

FIG. 1 is a schematic diagram of an example of a drilling system 100 using cutting element assemblies disclosed herein. FIG. 1 shows a wellbore 110 that may include an upper section 111 with a casing 112 installed therein and a lower section 114 that is being drilled with a drill string 118. The drill string 118 may include a tubular member 116 that carries a drilling assembly 130 at its bottom end. The tubular member 116 may be coiled tubing or may be formed by joining drill pipe sections. A drill bit 150 (also referred to as "pilot bit") may be attached to the bottom end of the drilling assembly 130 for drilling a first, smaller diameter borehole 142 in the formation 119. A reamer bit 160 may be placed above or uphole of the drill bit 150 in the drill string to enlarge the borehole 142 to a second, larger diameter borehole 120. The terms "wellbore" and "borehole" are used herein synonymously.

The drill string 118 may extend to a rig 180 at the surface 167. The rig 180 shown is a land rig for ease of explanation. The apparatus and methods disclosed herein equally apply when an offshore rig is used for drilling underwater. A rotary table 169 or a top drive may rotate the drill string 118 and the drilling assembly 130, and thus the pilot bit 150 and reamer bit 160, to respectively form boreholes 142 and 120. The rig 180 may also include conventional devices, such as mechanisms to add additional sections to the tubular member 116 as the wellbore 110 is drilled. A surface control unit 190, which may be a computer-based unit, may be placed at the surface for receiving and processing downhole data transmitted by the drilling assembly 130 and for controlling the operations of the various devices and sensors 170 in the drilling assembly 130. A drilling fluid from a source 179 thereof is pumped under pressure through the tubular member 116 that discharges at the bottom of the pilot bit 150 and returns to the surface via the annular space (also referred to as the "annulus") between the drill string 118 and an inside wall of the wellbore 110.

During operation, when the drill string 118 is rotated, both the pilot bit 150 and the reamer bit 160 may rotate. The pilot bit 150 drills the first, smaller diameter borehole 142, while simultaneously the reamer bit 160 enlarges the borehole 142 to a second, larger diameter. The Earth's subsurface formation may contain rock strata made up of different rock structures that can vary from soft formations to very hard formations, and therefore the pilot bit 150 and/or the reamer bit 160 may be selected based on the formations expected to be encountered in a drilling operation.

Figure 2:
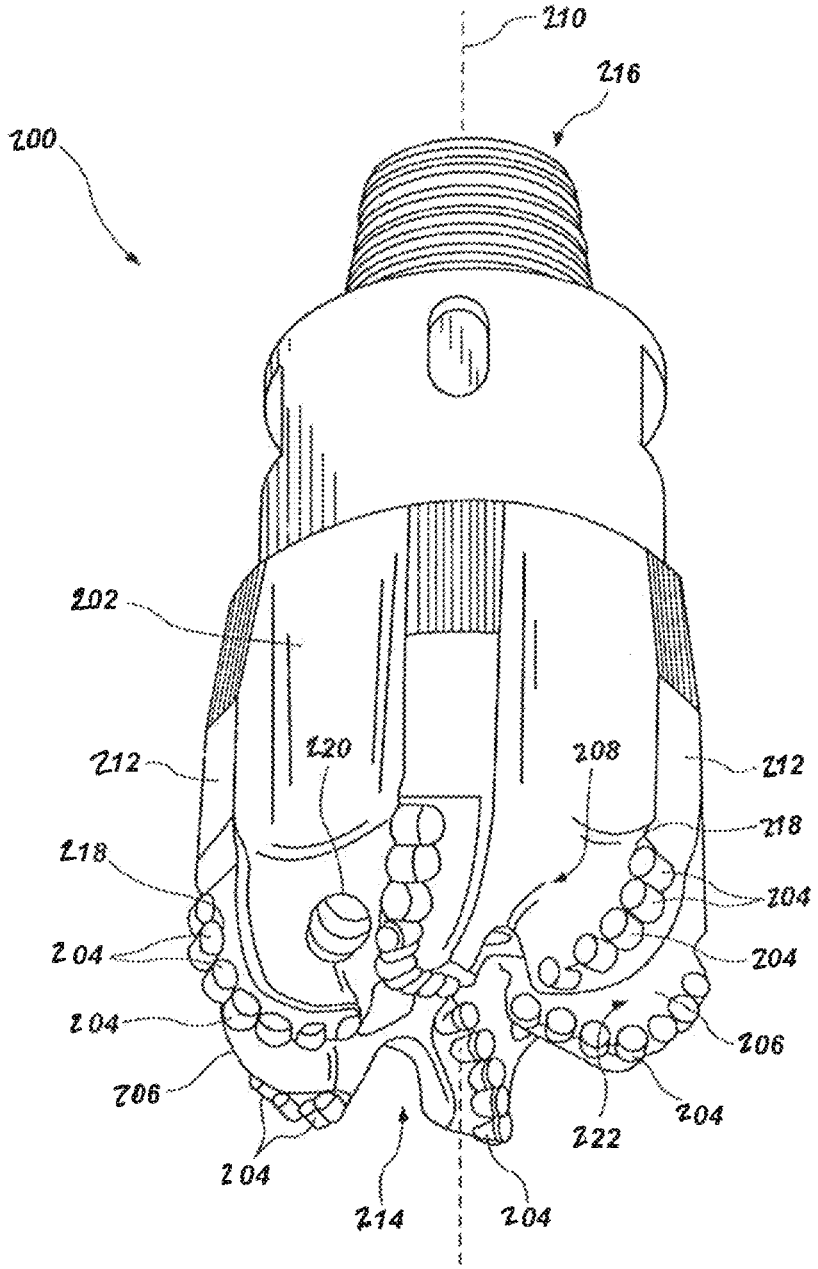
FIG. 2 is a simplified perspective view of a fixed-blade earth-boring rotary drill bit that may be used in conjunction with the drilling system of FIG. 1.

Referring to FIG. 2, a perspective view of an earth-boring tool 200 is shown. The earth-boring tool 200 may include a body 202 having cutting elements 204 secured to the body 202. The earth-boring tool 200 shown in FIG. 2 may be configured as a fixed-cutter drill bit, but other earth-boring tools having cutting elements 204 secured to a body may be employed, such as, for example, those discussed previously in connection with the term "earth-boring tool." The earth-boring tool 200 may include blades 206 extending outward from a remainder of the body 202, with junk slots 208 being located rotationally between adjacent blades 206. The blades 206 may extend radially from proximate an axis of rotation 210 of the earth-boring tool 200 to a gage region 212 at a periphery of the earth-boring tool 200. The blades 206 may extend longitudinally from a face 214 at a leading end of the earth-boring tool 200 to the gage region 212 at the periphery of the earth-boring tool 200. The earth-boring tool 200 may include a shank 216 at a trailing end of the earth-boring tool 200 longitudinally opposite the face 214. The shank 216 may have a threaded connection portion, which may conform to industry standards (e.g., those promulgated by the American Petroleum Institute (API)), for attaching the earth-boring tool 200 to a drill string.

The cutting elements 204 may be secured within pockets 218 formed in the blades 206. Nozzles 220 located in the junk slots 208 may direct drilling fluid circulating through the drill string toward the cutting elements 204 to cool the cutting elements 204 and remove cuttings of earth material. The cutting elements 204 may be positioned to contact, and remove, an underlying earth formation in response to rotation of the earth-boring tool 200 when weight is applied to the earth-boring tool 200. For example, cutting elements 204 in accordance with this disclosure may be primary or secondary cutting elements (i.e., may be the first or second surface to contact an underlying earth formation in a given cutting path), and may be located proximate the rotationally leading surface 222 of a respective blade 206 or may be secured to the respective blade 206 in a position rotationally trailing the rotationally leading surface 222.

Figure 3A:
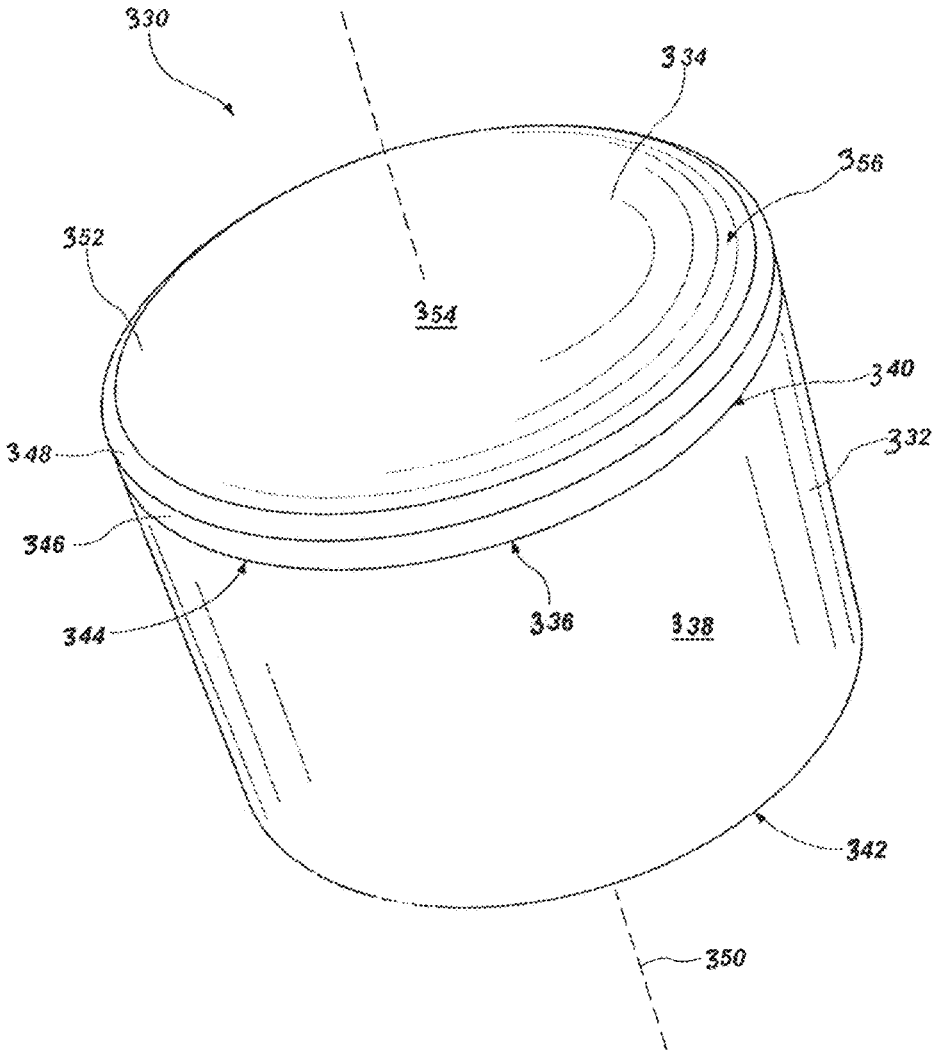
FIG. 3A is a perspective view of a cutting element usable with the earth-boring tool of FIG. 2 according to one or more embodiments of the present disclosure.

FIG. 3A is a perspective view of an embodiment of a cutting element 330 usable with the earth-boring tool 200 of FIG. 2. The cutting element 330 may include a substrate 332 (e.g., a base portion) and a table of polycrystalline, superabrasive material 334 (e.g., an upper portion) secured to an end 336 of the substrate 332. More specifically, the polycrystalline, superabrasive material 334 may be a polycrystalline diamond compact (PDC). The substrate 332 may be generally cylindrical in shape. For example, the substrate 332 may include a curved side surface 338 extending around a periphery of the substrate 332 and end surfaces 340 and 342. In some embodiments, the end surfaces 340 and 342 may have a circular or oval shape, for example. The end surfaces 340 and 342 may be, for example, planar or nonplanar. For instance, the end surface 340 forming an interface between the substrate 332 and the polycrystalline, superabrasive material 334 may be nonplanar.

In some embodiments, the substrate 332 may include a chamfer transitioning between the curved side surface 338 and one or more of the end surfaces 340 and 342, typically between curved side surface 338 and end surface 342. The substrate 332 may have a center longitudinal axis 350 extending parallel to the curved side surface 338 through geometric centers of the end surfaces 340 and 342. The substrate 332 may include hard, wear-resistant materials suitable for use in a downhole drilling environment. For example, the substrate 332 may include metal, metal alloys, ceramic, and/or metal-ceramic composite (i.e., "cermet") materials. As a specific, non-limiting example, the substrate 332 may include a cermet including particles of tungsten carbide cemented in a metal or metal alloy matrix.

The polycrystalline, superabrasive material 334 may include an interfacial surface 344 abutting, and secured to, the end surface 340 of the substrate 332. The polycrystalline, superabrasive material 334 may be generally disc-shaped, and may include a side surface 346 extending longitudinally from the interfacial surface 344 away from the substrate 332. The side surface 346 may be curved, and may be, for example, flush with the curved side surface 338 of the substrate 332.

The polycrystalline, superabrasive material 334 may include a first transition surface 348 (e.g., a primary chamfer) extending from the side surface 346 away from the substrate 332. The first transition surface 348 may have a frustoconical shape, and may comprise what is often referred to in the art as a "chamfer" surface. The first transition surface 348 may extend away from the substrate 332 in a first direction oblique to a center longitudinal axis 350 of the substrate 332. Additionally, the first transition surface 348 may extend radially from the side surface 346 at the periphery of the polycrystalline, superabrasive material 334 inward toward the center longitudinal axis 350. In some embodiments, the polycrystalline, superabrasive material 334 may lack the side surface 346, such that the first transition surface 348 may begin at an intersection (e.g., an edge) with the interfacial surface 344 located adjacent to the end surface 340 of the substrate 332.

In some embodiments, the polycrystalline, superabrasive material 334 may further include a second transition surface 352 (e.g., a secondary chamfer) extending from the first transition surface 348 away from the substrate 332. For example, the polycrystalline, superabrasive material 334 may include any of the second transition surfaces described in U.S. patent application Ser. No. 15/584,943, to Borge, filed May 2, 2017, the disclosure of which is incorporated in its entirety by reference herein. For instance, the second transition surface 352 may extend away from the substrate 332 in a second direction oblique to the center longitudinal axis 350 of the substrate 332. The second direction in which the second transition surface 352 extends may be different from the first direction in which the first transition surface 348 extends. The second transition surface 352 may extend radially from the first transition surface 348 at the radially innermost extent thereof inward toward the center longitudinal axis 350. For example, the second transition surface 352 may extend radially inward more rapidly than the first transition surface 348.

In some embodiments, such as that shown in FIG. 3A, the polycrystalline, superabrasive material 334 may include a cutting face 354 extending from either the first transition surface 348 or the second transition surface 352 radially inward to the center longitudinal axis 350. The cutting face 354 may extend, for example, in a direction perpendicular to the center longitudinal axis 350. Each of the first transition surface 348, the second transition surface 352, and the cutting face 354 may have a cross-sectional shape at least substantially similar to, though smaller in a radial extent than, a cross-sectional shape of the curved side surface 338 and side surface 346 of the substrate 332 and the polycrystalline, superabrasive material 334.

In some embodiments, the cutting face 354 may exhibit a different degree of roughness than a remainder of the exposed surfaces of the polycrystalline, superabrasive material 334. For example, the cutting face 354 may be rougher than (e.g., may be polished to a lesser degree or with a less fine polish) the remainder of the exposed surfaces of the polycrystalline, superabrasive material 334. More specifically, a difference in surface roughness between the cutting face 354 and the remainder of the exposed surfaces of the polycrystalline, superabrasive material 334 may be, for example, between about 1 μin Ra and about 30 μin Ra. Ra may be defined as the arithmetic average of the absolute values of profile height deviations from the mean line, recorded within an evaluation length. Stated another way, Ra is the average of a set of individual measurements of a surface's peaks and valleys. As a specific, non-limiting example, the difference in surface roughness between the cutting face 354 and the remainder of the exposed surfaces of the polycrystalline, superabrasive material 334 may be between about 20 μin Ra and about 25 μin Ra. As continuing examples, a surface roughness of the cutting face 354 may be between about 20 μin Ra and about 40 μin Ra, and a surface roughness of the remainder of the exposed surface of the polycrystalline, superabrasive material 334 may be between about 1 μin Ra and about 10 μin Ra. More specifically, the surface roughness of the cutting face 354 may be, for example, between about 20 μin Ra and about 30 μin Ra, and the surface roughness of the remainder of the exposed surface of the polycrystalline, superabrasive material 334 may be, for example, between about 1 μin Ra and about 7 μin Ra. As specific, non-limiting examples, a surface roughness of the cutting face 354 may be between about 22 μin Ra and about 27 μin Ra (e.g., about 25 μin Ra), and a surface roughness of the remainder of the exposed surface of the polycrystalline, superabrasive material 334 may be between about 1 μin Ra and about 5 μin Ra (e.g., about 1 μin Ra). The change in direction from the second transition surface 352 to the cutting face 354, and the optional change in roughness in certain embodiments, may cause cuttings produced by the cutting element 330 to break off, acting as a chip breaker.

By increasing the number of transition surfaces relative to a cutting element with a single chamfer, the cutting element 330 may increase the time over which an impulse resulting from contact with an earth formation may act on the cutting element. As a result, the cutting element 330 may reduce peak collision force, reducing impact and chip damage and increasing the useful life of the cutting element 330.

As is discussed in greater detail below, in some embodiments, the cutting element 330 may further include a curved, stress-reduction feature formed and located at least on the first transition surface 348. The curved, stress-reduction feature may be sized and shaped to induce a beneficial stress state within the polycrystalline, superabrasive material 334. More specifically, the curved-stress-reduction feature may reduce the likelihood that tensile stresses will occur, and may reduce the magnitude of any tensile stresses that appear, in the polycrystalline, superabrasive material 334.

Figure 3B:
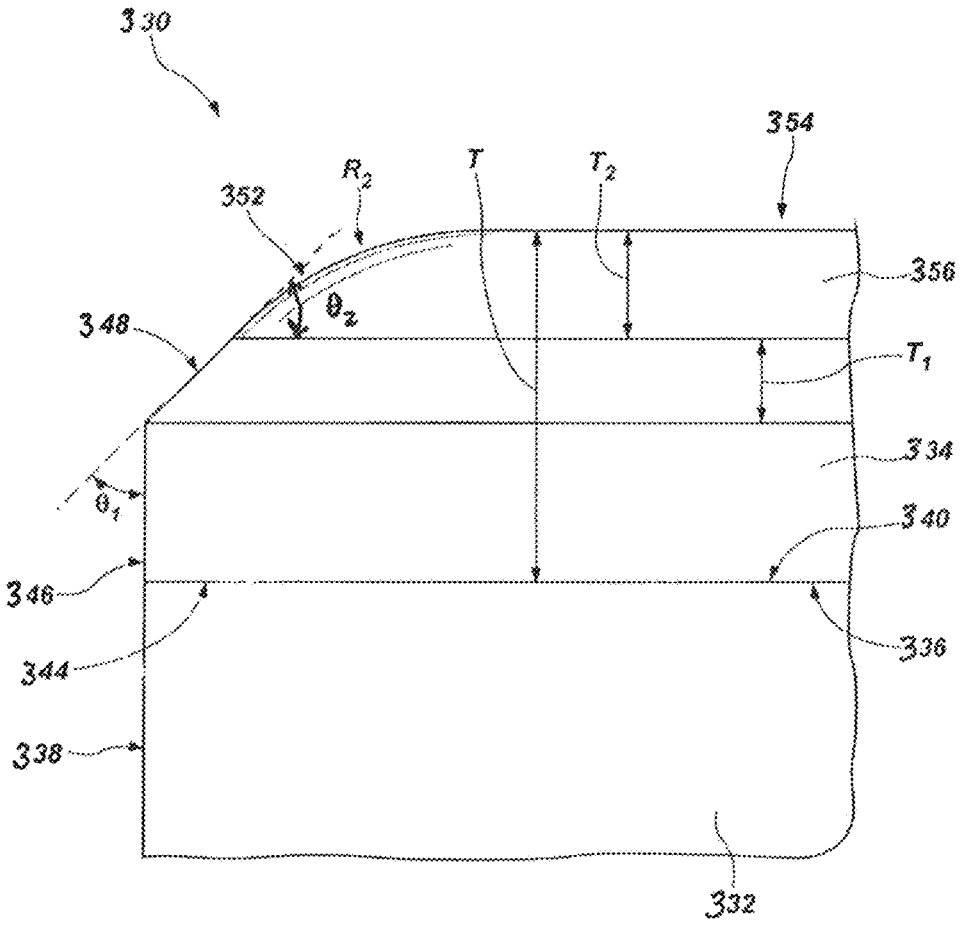
FIG. 3B is a side view of a portion of the cutting element of FIG. 3A.

FIG. 3B is a side view of a portion of the cutting element 330 of FIG. 3A. As shown in FIGS. 3A and 3B, the first transition surface 348 may be a chamfered surface in some embodiments. For example, the first transition surface 348 may extend at a constant slope from the side surface 346 toward the center longitudinal axis 350. More specifically, a first acute angle $\theta_1$ between the first transition surface 348 and the center longitudinal axis 350 may be, for example, between about 30° and about 60°. As a specific, non-limiting example, the first acute angle $\theta_1$ between the first transition surface 348 and the center longitudinal axis 350 may be between about 40° and about 50° (e.g., about 45°). A first thickness $T_1$ of the first transition surface 348 as measured in a direction parallel to the center longitudinal axis 350 may be, for example, between about 5% and about 20% of a total thickness T of the polycrystalline, superabrasive material 334 as measured in the same direction. More specifically, the first thickness $T_1$ of the first transition surface 348 may be, for example, between about 7% and about 15% of the total thickness T of the polycrystalline, superabrasive material 334. As a specific, non-limiting example, the first thickness $T_1$ of the first transition surface 348 may be between about 8% and about 12% (e.g., about 10%) of the total thickness T of the polycrystalline, superabrasive material 334. The first thickness $T_1$ of the first transition surface 348 may be, as another example, between about 0.20 mm and about 0.55 mm. More specifically, the first thickness $T_1$ of the first transition surface 348 may be, for example, between about 0.38 mm and about 0.44 mm. As a specific, non-limiting example, the first thickness $T_1$ of the first transition surface 348 may be about 0.40 mm.

In some embodiments, the second transition surface 352 may be a truncated dome shape in some embodiments, such as that shown in FIGS. 3A and 3B. For example, a slope of the second transition surface 352 may change at least substantially continuously, and at an at least substantially constant rate, from the first transition surface 348 to the cutting face 354. More specifically, a radius of curvature $R_2$ of the second transition surface 352 may be, for example, between about 0.51 mm and about 3.3 mm. As a specific, non-limiting example, the radius of curvature $R_2$ of the second transition surface 352 may be, for example, between about 1.5 mm and about 2.54 mm (e.g., about 2 mm). A second thickness $T_2$ of the second transition surface 352 as measured in a direction parallel to the center longitudinal axis 350 may be greater than the first thickness $T_1$ of the first transition surface 348 and may be, for example, between about 5% and about 50% of the total thickness T of the polycrystalline, superabrasive material 334 as measured in the same direction. More specifically, the second thickness $T_2$ of the second transition surface 352 may be, for example, between about 15% and about 45% of the total thickness T of the polycrystalline, superabrasive material 334. As a specific, non-limiting example, the second thickness $T_2$ of the second transition surface 352 may be between about 20% and about 35% (e.g., about 30%) of the total thickness T of the polycrystalline, superabrasive material 334. The second thickness $T_2$ of the second transition surface 352 may be, as another example, between about 0.254 mm and about 1.27 mm. More specifically, the second thickness $T_2$ of the second transition surface 352 may be, for example, between about 0.50 mm and about 1.1 mm. As a specific, non-limiting example, the second thickness $T_2$ of the second transition surface 352 may be about 0.77 mm.

In additional embodiments, the second transition surface 352 may be a chamfered surface. For example, the second transition surface 352 may extend at a constant slope from the first transition surface 348 toward the center longitudinal axis 350. In one or more embodiments, the slope of the second transition surface 352 (e.g., at least an initial portion of the second transition surface 352 when the second transition surface 352 comprises a truncated dome) may define a second acute angle $\theta_2$ relative to a plane to which the center longitudinal axis 350 of the cutting element 330 is normal. In some embodiments, the second acute angle $\theta_2$ may be within a range of about 0° and about 60°. As a non-limiting example, the second acute angle $\theta_2$ may be within a range of about 0° and about 30°. As will be appreciated by one of ordinary skill in the art, when the second acute angle $\theta_2$ is equal to 0°, the cutting element 330 does not include a second transition surface 352. Selecting the second acute angle $\theta_2$ enables an aggressiveness of the cutting element 330 to be selected.

Although the cutting element 330 is described above as including both a first transition surface 348 and a second transition surface 352, the disclosure is not so limited. Rather, in some embodiments, the cutting element 330 may only include the first transition surface 348 (i.e., only one transition surface). For instance, including both the first transition surface 348 and the second transition surface 352 is not required in every embodiment.

Figure 4:
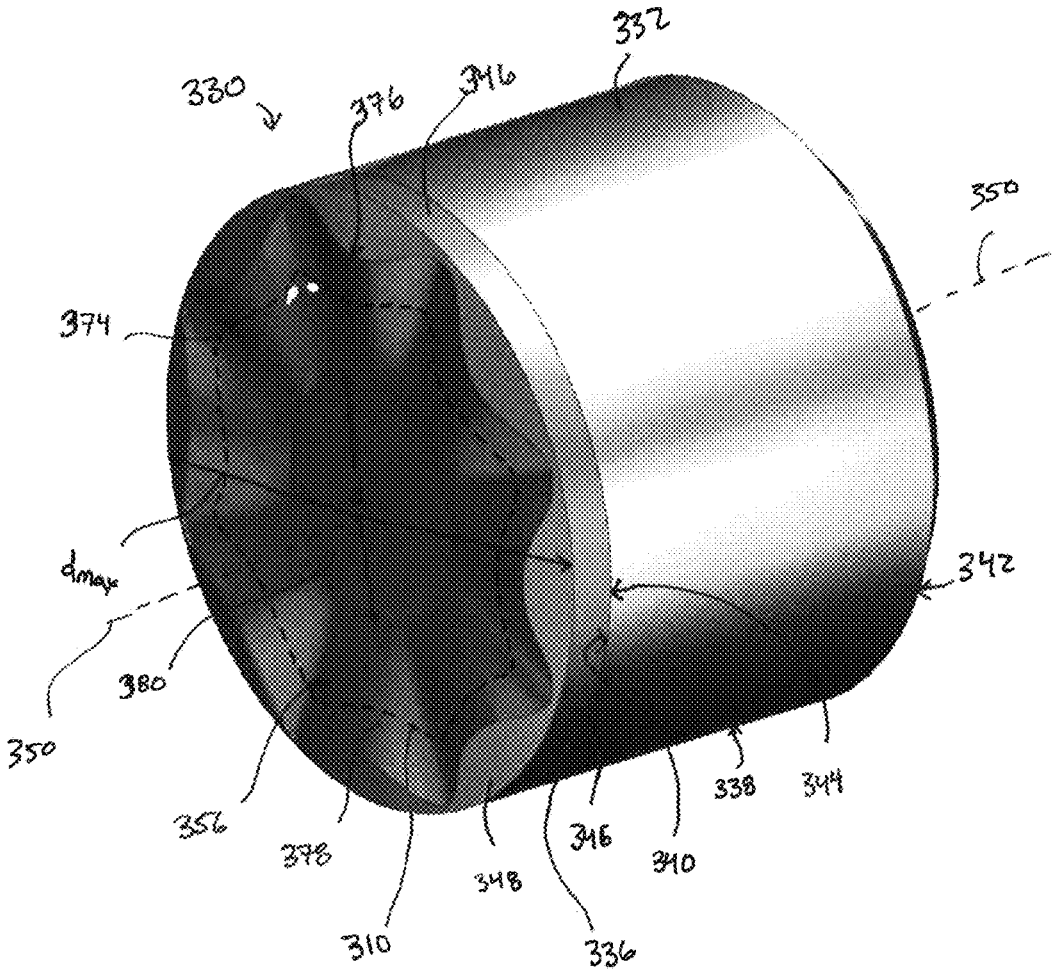
FIG. 4 is a perspective view of another cutting element usable with the earth-boring tool of FIG. 2 according to one or more embodiments of the present disclosure.

FIG. 4 is a perspective view of a cutting element 330 usable with the earth-boring tool 200 of FIG. 2 according to one or more embodiments of the present disclosure. As shown in FIG. 4, in some embodiments, the curved, stress-reduction feature 356 may include a waveform 374 formed in at least the first transition surface 348 (e.g., the primary chamfer) of the cutting element 330. More specifically, the first transition surface 348 may extend from the side surface 346 of the substrate 332 to an undulating edge 376 at a longitudinally uppermost extent of the first transition surface 348 farthest from the substrate 332. The undulating edge 376 may exhibit, for example, a sinusoidal shape. A surface 378 (i.e., a front surface) of the waveform 374 may extend from the undulating edge 376 radially inward toward the center longitudinal axis 350 of the cutting element 330. Furthermore, due to the sinusoidal shape of the undulating edge 376, the surface 378 of the waveform 374 may define a plurality of troughs and a plurality of peaks. The surface 378 of the waveform 374 may also extend longitudinally from the undulating edge 376 toward the substrate 332, such that the surface 378 extends in a third direction oblique to the center longitudinal axis 350. More specifically, in some embodiments, the troughs of the waveform 374 may extend in a radial direction perpendicular to the center longitudinal axis 350, and the peaks of the waveform 374 may extend in a radial direction oblique to the center longitudinal axis 350, such that the height of the peaks decreases as a radial distance from the center longitudinal axis 350 decreases. In additional embodiments, the peaks of the waveform 374 may extend in a radial direction perpendicular to the center longitudinal axis 350, and the troughs of the waveform 374 may extend in a radial direction oblique to the center longitudinal axis 350, such that the depth of the troughs decreases as a radial distance from the center longitudinal axis 350 decreases.

In some embodiments, the undulating edge 376 may define a radially innermost edge of the first transition surface 348. For instance, the undulating edge 376 may undulate inward and outward radially relative to the center longitudinal axis 350 of the cutting element 330.

In embodiments including a second transition surface 352, the stress-reduction feature 356 may extend from the first transition surface 348 and through the second transition surface 352. For example, in some embodiments, the undulating edge 376 and undulate back and forth between the first transition surface 348 and the second transition surface 352. Additionally, in some embodiments, the undulating edge 376 may extend completely through the second transition surface 352 and into a planar surface of the cutting element 330. Moreover, in one or more embodiments, the undulating edge 376 may intersect the edge defined at the intersection between the first transition surface 348 and the side surface 346. In alternative embodiments the undulating edge 376 may be spaced apart from the edge defined at the intersection between first transition surface 348 and the side surface 346 by at least some distance.

Furthermore, although the stress-reduction feature 356 is described as extending from the first transition surface 348, the disclosure is not so limited, and rather, the stress-reduction feature 356 may extend from the second transition surface 352 in any of the manners described in U.S. patent application Ser. No. 15/584,943, to Borge, filed May 2, 2017.

As the surface 378 of the waveform 374 extends radially inward, the surface 378 of the waveform 374 may intersect with a planar surface 380 extending perpendicular to, and intersected by, the center longitudinal axis 350. The planar surface 380 may be located, for example, in the same position along the center longitudinal axis 350 as the edge defined at the intersection between the first transition surface 348 and the side surface 346. In other embodiments, the planar surface 380 may be located at a different position along the center longitudinal axis 350 as the edge defined at the intersection between the first transition surface 348 and the side surface 346. A diameter d of the planar surface 380 may be, for example, between about 10% and about 50% of a maximum diameter $d_{max}$ of the polycrystalline, superabrasive material 334. More specifically, the diameter d of the planar surface 380 may be, for example, between about 20% and about 40% of the maximum diameter $d_{max}$ of the polycrystalline, superabrasive material 334. As a specific, non-limiting example, the diameter d of the planar surface 380 may be, for example, between about 25% and about 35% (e.g., about 30%) of the maximum diameter $d_{max}$ of the polycrystalline, superabrasive material 334. In some embodiments, the planar surface 380 may exhibit a different degree of roughness than a remainder of the exposed surfaces of the polycrystalline, superabrasive material 334. For example, the planar surface 380 may be rougher than (e.g., may be polished to a lesser degree or with a less fine polish) the remainder of the exposed surfaces of the polycrystalline, superabrasive material 334. The change in direction from the surface 378 of the waveform 374 to the planar surface 380, and the optional change in roughness in certain embodiments, may cause cuttings produced by the cutting element 330 to break off, acting as a chip breaker.

A frequency of the waveform 374 may be, for example, between about one peak every 180° and about ten peaks every 90°. More specifically, the frequency of the waveform 374 may be, for example, between about two peaks every 90° and about eight peaks every 90°. As a specific, non-limiting example, the frequency of the waveform 374 may be, for example, between about three peaks every 90° and about seven peaks every 90° (e.g., about five peaks every 90°). In one or more embodiments, the cutting element 330 may include any of the stress-reduction features 356 and waveforms 374 describe in co-pending U.S. patent application Ser. No. 16/047,863, "CUTTING ELEMENTS CONFIGURED TO REDUCE IMPACT DAMAGE RELATED TOOLS AND METHODS—ALTERNATE CONFIGURATIONS," filed Jul. 27, 2018, the entire disclosure of which is hereby incorporated herein by this reference.

In embodiments where the cutting element 330 includes a waveform 374, such as that shown in FIG. 4, the first portion of the cutting element 330 to contact an underlying earth formation may be the peak or peaks of the waveform 374 that are being forced into the earth formation by applied weight on the earth-boring tool 200 (FIG. 2). As a result, the surface area that initially contacts the earth formation may be reduced, which may increase the stress induced in the earth formation to better initiate and propagate cracks therein. Additionally, the waveform 374 may induce beneficial stress states within the cutting element 330, and the waveform 374 may increase fluid flow across the polycrystalline, superabrasive material 334, improving cooling and facilitating removal of cuttings. In view of the foregoing, the stress-reduction feature 356 may improve an overall durability of the cutting face 354 of the cutting element 330 and may reduce wear experienced by the cutting face 354 of the cutting element 330.

Additionally, the cutting element 330 may include at least one recess 310 (e.g., disruption, groove, engraving, channel, etc.) defined in the surface 378 of the waveform 374 of the stress-reduction feature 356. In some embodiments, the at least one recess 310 may include a plurality of recesses 310 defined in the surface 378 of the waveform 374 of the stress-reduction feature 356. For instance, the at least one recess 310 may include a plurality of smaller recesses oriented in series relative to one another. Put another way, the at least one recess 310 may be segmented. In other embodiments, the at least one recess 310 may be continuous. Moreover, in some embodiments, the at least one recess 310 may define and/or be oriented in a pattern. For example, in the embodiment depicted in FIG. 4, the at least one recess 310 may define a shape similar to the undulating edge 376. For instance, the at least one recess 310 may be oriented in a shape concentric to the undulating edge 376 and formed in the surface 378 of the waveform 374 of the stress-reduction feature 356. The orientations of and patterns formed by the at least one recess 310 are described in greater detail below in regard to FIGS. 8 and 9.

Figure 5:
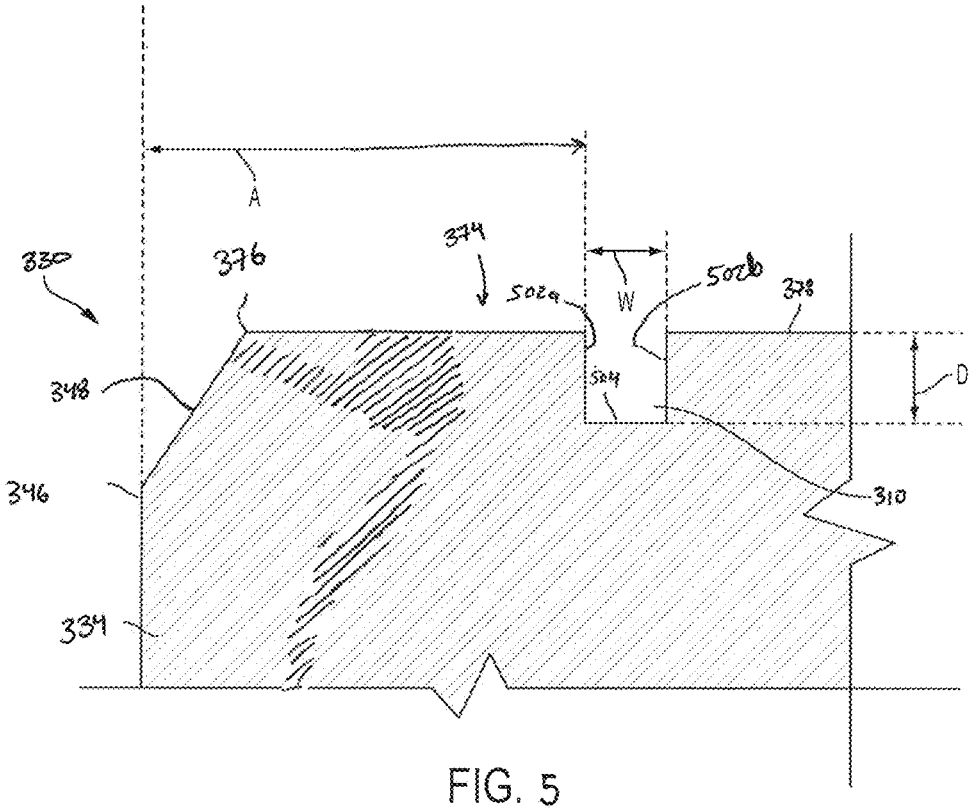
FIG. 5 partial cross-sectional side view of the polycrystalline, superabrasive material of cutting elements according to other embodiments of the present disclosure.

FIG. 5 is a simplified cross-sectional side view of the polycrystalline, superabrasive material 334 of the cutting element 330 of FIG. 2. The dimensions of the at least one recess 310 are exaggerated in order to better show the dimensions, shape, and orientation of the at least one recess 310. As shown in FIG. 5, the at least one recess 310 may include opposing sidewalls 502*a*, 502*b* and a base wall 504. Furthermore, the at least one recess 310 may have a depth D and width W. In some embodiments, an intersection of a radially outermost sidewall 502*a* of the at least one recess 310 and the surface 378 of the waveform 374 may be radially located some average distance A from the outer peripheral edge (e.g., an intersection of the first transition surface 348 and the side surface 346) of the polycrystalline, superabrasive material 334 or from the undulating edge 376. In some embodiments, the average distance A may be within a range of 0.5 mm to 4.0 mm. In other embodiments, the distance A may be within a range of 0.5 mm to 2.0 mm. In other embodiments, the average distance A may be within a range of 0.5 mm to 1.5 mm. For example, in some embodiments, the average distance A may be within a range of 1.0 mm to 1.5 mm.

In some embodiments, the average distance A may be a percentage of a diameter of the cutting element 330. For example, in some embodiments the average distance A may be within a range of 4.0% to 42.0% of the diameter of the cutting element 330. For example, in some embodiments, the average distance A may be within a range of 4.0% to 13.0% of the diameter of the cutting element 330. In other embodiments, the average distance A may be within a range of 12.0% to 41% of the diameter of the cutting element 330. In some embodiments, the diameter of the cutting element 330 may be within a range of 8 mm to 25 mm.

The depth D of the at least one recess 310 may be a measurement of a length extending from the surface 378 of the waveform 374 of the polycrystalline, superabrasive material 334 to the base wall 504 of the at least one recess 310. In some embodiments, the at least one recess 310 may have a depth D within a range of 25.0 μm to 600 μm. In other embodiments, the at least one recess 310 may have a depth D within a range of 25.0 μm to 300 μm. In yet other embodiments, the at least one recess 310 may have a depth D within a range of 25.0 μm to 200 μm. In yet other embodiments, the at least one recess 310 may have a depth D within a range of 25.0 μm to 150 μm. In yet other embodiments, the at least one recess 310 may have a depth D within a range of 25.0 μm to 100 μm. In yet other embodiments, the at least one recess 310 may have a depth D within a range of 25.0 μm to 50 μm. In yet other embodiments, the at least one recess 310 may have a depth D within a range of 75.0 μm to 150 μm. In one or more embodiments, the depth D of the at least one recess 310 may vary along a length of the at least one recess 310.

In some embodiments, the polycrystalline, superabrasive material 334 may contain a metal catalyst used to form the polycrystalline, superabrasive material 334 via an HPHT process, as is known in the art. In such embodiments, the metal catalyst may be substantially removed from a portion of the polycrystalline, superabrasive material 334, such as behind the surface 378 of the waveform 374, inwardly of the side surface 346 of the polycrystalline, superabrasive material 334, or both. In some embodiments, the at least one recess 310 may extend through an entire depth of the polycrystalline, superabrasive material 334 from which catalyst has been removed, while in other embodiments, the at least one recess 310 may be contained within the depth of substantially catalyst-free polycrystalline diamond. In other embodiments, the metal catalyst may not be substantially removed from a portion of the polycrystalline, superabrasive material 334, and the at least one recess 310 may be defined in a portion of the polycrystalline, superabrasive material 334 containing a metal catalyst. In embodiments where the metal catalyst has not be substantially removed from a portion of the polycrystalline, superabrasive material 334, the polycrystalline, superabrasive material 334 may be cooled while the at least one recess 310 is formed in the surface 378 of the waveform 374 of the polycrystalline, superabrasive material 334. In some embodiments, the surface 378 of the waveform 374 may be cooled with a heat sink.

The width W of the at least one recess 310 may be a measurement of a length between the first sidewall 502*a* and the second opposing sidewall 502*b* of the at least one recess 310. In some embodiments, the at least one recess 310 may have a width W within a range of 25.0 μm to 650 μm. In other embodiments, the at least one recess 310 may have a width W within a range of 25.0 μm to 300 μm. In yet other embodiments, the at least one recess 310 may have a width W within a range of 250 μm to 200 μm. In yet other embodiments, the at least one recess 310 may have a width W within a range of 25.0 μm to 150 μm. In yet other embodiments, the at least one recess 310 may have a width W within a range of 25.0 μm to 100 μm. In yet other embodiments, the at least one recess 310 may have a width W within a range of 25.0 μm to 50 μm. In yet other embodiments, the at least one recess 310 may have a width W within a range of 100.0 μm to 200 μm. As will be appreciated by someone of ordinary skill in the art, in embodiments having more than one recess 310, the recesses 310 may have differing widths and depths relative to one another. Further, although the recesses 310 are shown as having linear walls and floors joined at sharp corners, it will be understood by those of ordinary skill in the art that such linearity and sharp definition between surfaces may not necessarily exist and are employed herein for purposes of clarity of explanation.

As shown in FIG. 5, surfaces of the sidewalls 502*a*, 502*b* of the at least one recess 310 may be at least generally perpendicular to the region of the surface 378 of the waveform 374 of the polycrystalline, superabrasive material 334 where the at least one recess 310 is formed. Furthermore, in some embodiments, the base wall 504 of the at least one recess 310 may be at least generally flat. In additional embodiments, the base wall 504 may be curved and may match a curvature of the surface 378 of the waveform 374 where the at least one recess 310 is formed. For example, a surface of the base wall 504 may be at least generally parallel to the surface 378 of the waveform 374 of the polycrystalline, superabrasive material 334 where the at least one recess 310 is formed. Furthermore, in additional embodiments, one or more of the sidewalls 502*a*, 502*b* and base wall 504 of the at least one recess 310 may have curved, rounded, slanted, uneven, and/or irregular surfaces. In some embodiments, the width W of the at least one recess 310 may be at least substantially uniform throughout the depth D of the at least one recess 310. In other embodiments, the width W of the at least one recess 310 may decrease as the depth D of the at least one recess 310 increases. For example, at width of the base wall 504 of the at least one recess 310 may be smaller than the width W of the at least one recess 310 at the surface 378 of the waveform 374 of the polycrystalline, superabrasive material 334. In some embodiments, the intersections of the base wall 504 with the sidewalls 502*a*, 502*b* may be rounded to decrease stress concentrations around the at least one recess 310. However, it is understood that in some embodiments intersections of the base wall 504 with the sidewalls 502*a*, 502*b* of the at least one recess 310 may be sharp and/or irregular.

In some embodiments, the base wall 504 of the at least one recess 310 may have a general waveform shape in axial direction of the cutting element 330. For example, the at least one recess 310 may follow the waveform 374, and the base wall 504 of the at least one recess 310 may undulate up and down (in the axial direction) and may at least substantially match the undulation of the waveform 374 of the stress-reduction feature 356.

During a drilling operation employing a cutting element 330, the at least one recess 310 in the surface 378 of the waveform 374 of the polycrystalline, superabrasive material 334 may be configured to mitigate shallow spall propagation in the polycrystalline, superabrasive material 334 of the cutting element 330. As used herein, the terms "shallow spall" refer to spalls formed by fractures that occur at least substantially parallel to the surface 378 of the waveform 374 of the polycrystalline, superabrasive material 334 at about a distance of 1.0 μm to 60.0 μm from the surface 378 of the waveform 374 of the polycrystalline, superabrasive material 334 of the cutting element 330.

In some embodiments, the at least one recess 310 may mitigate shallow spall propagation in the polycrystalline, superabrasive material 334 of the cutting element 330 by tending to cause spalls to terminate at the at least one recess 310. In other words, the at least one recess 310 may create a void of material barrier in the polycrystalline, superabrasive material 334 such that when fractures in the polycrystalline, superabrasive material 334 reach the at least one recess 310, the at least one recess 310 may cease propagation of the fracture, and any resulting spall may break off of the polycrystalline, superabrasive material 334 at the at least one recess 310. Accordingly, in a drilling operation when the cutting element 330 is impacting earth formations, the at least one recess 310 may cause at least some resulting fractures in the polycrystalline, superabrasive material 334 (e.g., breaks, cracks, chips, etc.) to cease propagating at the at least one recess 310. As a result, when the at least one recess 310 is defined proximate the outer peripheral edge of the first transition surface 348 or the undulating edge 376 of the polycrystalline, superabrasive material 334, the at least one recess 310 may help to restrict shallow spalls to occurring in the polycrystalline, superabrasive material 334 at least substantially only near the first transition surface 348 or near the undulating edge 376 instead of at a location in the polycrystalline, superabrasive material 334 radially inward from at least one recess 310. As discussed in further detail below, restricting propagation of shallow spalls may result in the cutting element 330 being better suited for reuse after experiencing an initial spall during a drilling operation.

In some embodiments, the at least one recess 310 may mitigate shallow spall propagation in the polycrystalline, superabrasive material 334 of the cutting element 330 by suppressing (e.g., disrupting, stopping, minimizing, mitigating, etc.) surface wave (e.g., Rayleigh waves) propagation through the polycrystalline, superabrasive material 334 and across the surface 378 of the waveform 374 of the polycrystalline, superabrasive material 334 of the cutting element 330. Surface waves, which are a type of acoustic wave that travel through solid material, can be produced by localized impacts to the solid material and can contribute to material failure (e.g., spalls). As a result, by suppressing surface wave propagation, the at least one recess 310 may mitigate shallow spalling in the polycrystalline, superabrasive material 334 of the cutting element 330. Furthermore, because surface waves travel through solid materials, by having a break in geometry in the solid material, at least some surface waves may be suppressed.

In some embodiments, the at least one recess 310 may sufficiently mitigate shallow spalling such that during a drilling operation an initial spall occurring in the polycrystalline, superabrasive material 334 may be restricted to only a portion of the surface 378 of the waveform 374 of the polycrystalline, superabrasive material 334. For example, in some embodiments, the at least one recess 310 may mitigate shallow spalling such that an initial spall in polycrystalline, superabrasive material 334 only extends radially inward from the outer peripheral edge of the first transition surface 348 a distance of less than 6.5 mm. In other embodiments, the at least one recess 310 may mitigate shallow spalling such that an initial spall in the polycrystalline, superabrasive material 334 only extends radially inward from the outer peripheral edge of the first transition surface 348 a distance of less than 3.0 mm. In yet other embodiments, the at least one recess 310 may mitigate shallow spalling such that an initial spall in the polycrystalline, superabrasive material 334 only extends radially inward from the outer peripheral edge of the first transition surface 348, a distance of less than 2.0 mm. In yet other embodiments, the at least one recess 310 may mitigate shallow spalling such that an initial spall in the polycrystalline, superabrasive material 334 only extends radially inward from the outer peripheral edge of the first transition surface 348, a distance of less than 1.5 mm. In yet other embodiments, the at least one recess 310 may mitigate shallow spalling such that an initial spall in the polycrystalline, superabrasive material 334 only extends radially inward from the outer peripheral edge of the first transition surface 348, a distance of less than 1.1 mm. As a result, a lifespan (i.e., amount of time a cutting element 330 remains sufficiently effective during use) may be increased for a cutting element 330 by defining at least one recess 310 in the surface 378 of the waveform 374 of the polycrystalline, superabrasive material 334 of the cutting element 330 as described herein.

By restricting initial spalls on the surface 378 of the waveform 374 of the polycrystalline, superabrasive material 334 of the cutting element 330, the cutting element 330 may be re-used. Therefore, restricting initial spalls on the surface 378 of the waveform 374 of the polycrystalline, superabrasive material 334 of the cutting element may greatly increase the reusability of cutting elements 330, which may lead to significant cost savings and increased profit margins.

For example, referring to FIGS. 2 and 5 together, during a drilling operation, after an initial spall has occurred in the surface 378 of the waveform 374 of the polycrystalline, superabrasive material 334, the drilling operation may be stopped, and the cutting element 330 may be rotated (i.e., "spun") about its longitudinal axis within a cutting element pocket of a blade 206 in the earth-boring tool 200. In some embodiments, the cutting element 330 may be rotated within a cutting element pocket of a blade 206 by breaking a braze bond between the cutting element 330 and the pocket of a blade 206 through heat and rotating cutting element 330 within the cutting element pocket to present an unspalled portion of the polycrystalline, superabrasive material 334 for contact with a formation. In such an orientation, the cutting element 330 is again bonded the cutting element pocket of the blade 206, and the cutting element 330 may continue to be used in another drilling operation. Therefore, the cutting element 330 may be re-used such that replacing an entire cutting element 330 every time an initial spall occurs in a polycrystalline, superabrasive material 334 of a cutting element 330 can be avoided.

In some embodiments, the at least one recess 310 may be formed in the surface 378 of the waveform 374 of the polycrystalline, superabrasive material 334 of the cutting element 330 through laser ablation. For example, material may be removed from the surface 378 of the waveform 374 of the polycrystalline, superabrasive material 334 by irradiating the polycrystalline, superabrasive material 334 with a laser beam. In some embodiments, the material may be heated by the laser beam until the material evaporates, sublimates, or otherwise is removed from the polycrystalline, superabrasive material 334. Although the at least one recess 310 is described herein as being formed through laser ablation, it will be appreciated that the at least one recess 310 could be formed through any number of methods such as, for example, drilling, cutting, milling, chemical etching, electric discharge machining (EDM), etc.

In some embodiments, after the at least one recess 310 is formed, the at least one recess 310 may be filled with a material differing from the material of the polycrystalline, superabrasive material 334. For example, in some embodiments, the at least one recess 310 may be filled with silicon carbide after the at least one recess 310 is formed.

Figure 6A:
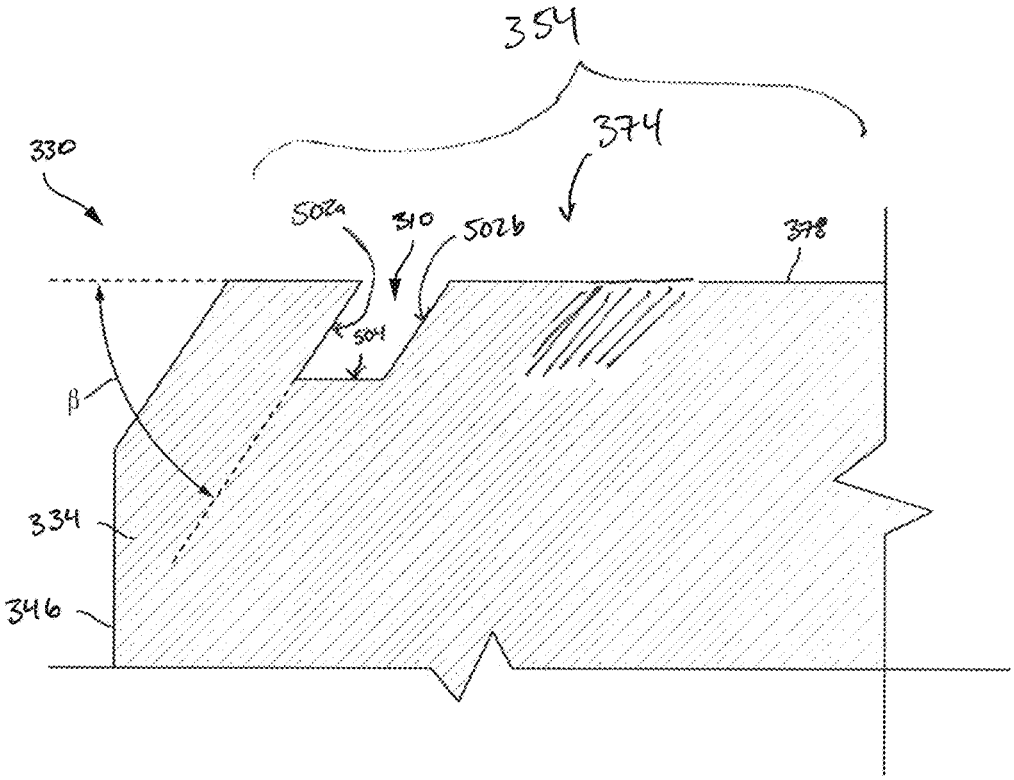
FIGS. 6A and 6B are partial cross-sectional side views of polycrystalline, superabrasive materials of cutting elements according to other embodiments of the present disclosure.
Figure 6B:
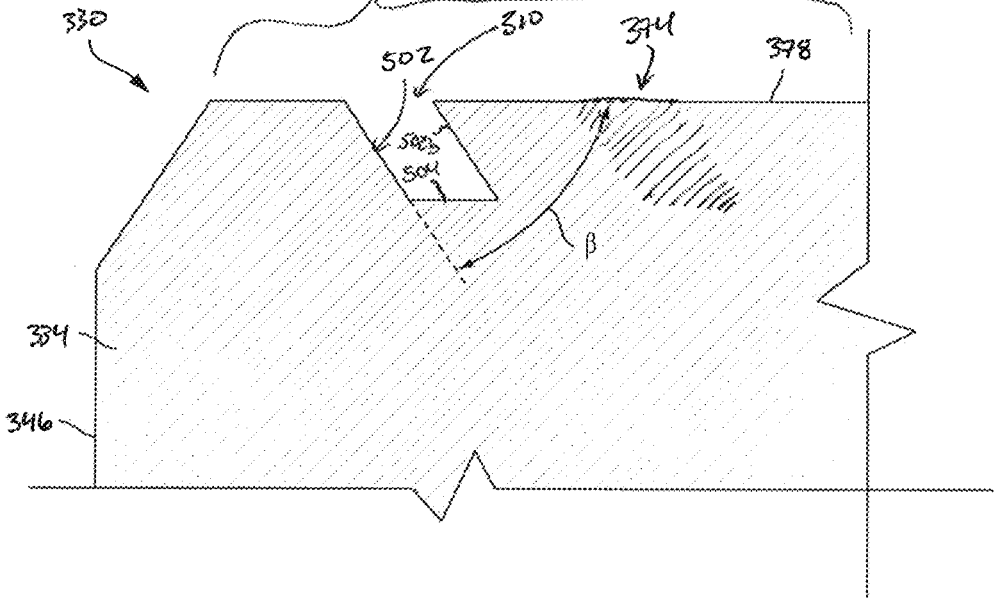

FIGS. 6A and 6B are partial cross-sectional side views of polycrystalline, superabrasive materials 334 of cutting elements 330 according to other embodiments of the present disclosure. Referring to FIGS. 6A and 6B together, in some embodiments, the surfaces of the sidewalls 502*a*, 502*b* of the at least one recess 310 may be oriented at an acute angle relative to the cutting face 354 of the polycrystalline, superabrasive material 334. The surfaces of the sidewalls 502*a*, 502*b* of the at least one recess 310 may be oriented at an acute angle relative to the cutting face 354 in order to facilitate directing fractures to propagate in a certain direction relative to the cutting face 354 of the polycrystalline, superabrasive material 334. For example, the surfaces of the sidewalls 502*a*, 502*b* of the at least one recess 310 may be oriented at an acute angle β relative to the cutting face 354 such that when fractures occur within the polycrystalline, superabrasive material 334, the fractures are more likely to propagate toward the side surface 346 or the center longitudinal axis 350 (FIG. 4) of the polycrystalline, superabrasive material 334 depending on the orientation of the surfaces of the sidewalls 502*a*, 502*b* of the of the at least one recess 310. In some embodiments, the surfaces of the sidewalls 502*a*, 502*b* of the of the at least one recess 310 may be oriented at an acute angle β relative to the cutting face 354 such that when the cutting face 354 fails the fracture propagates such that polycrystalline, superabrasive material 334 self sharpens after failing.

In embodiments having more than one recess 310, the surfaces of the sidewalls 502*a*, 502*b* of a first recess 310 may be oriented at least generally perpendicular to the cutting face 354 and the surfaces of the sidewalls 502*a*, 502*b* of a second recess 310 may be oriented at an acute angle β relative to the cutting face 354. In other embodiments, surfaces of the sidewalls 502*a*, 502*b* of both the first recess 310 and the second recess 310 may be oriented at an acute angle β relative to the cutting face 354.

Figure 7:
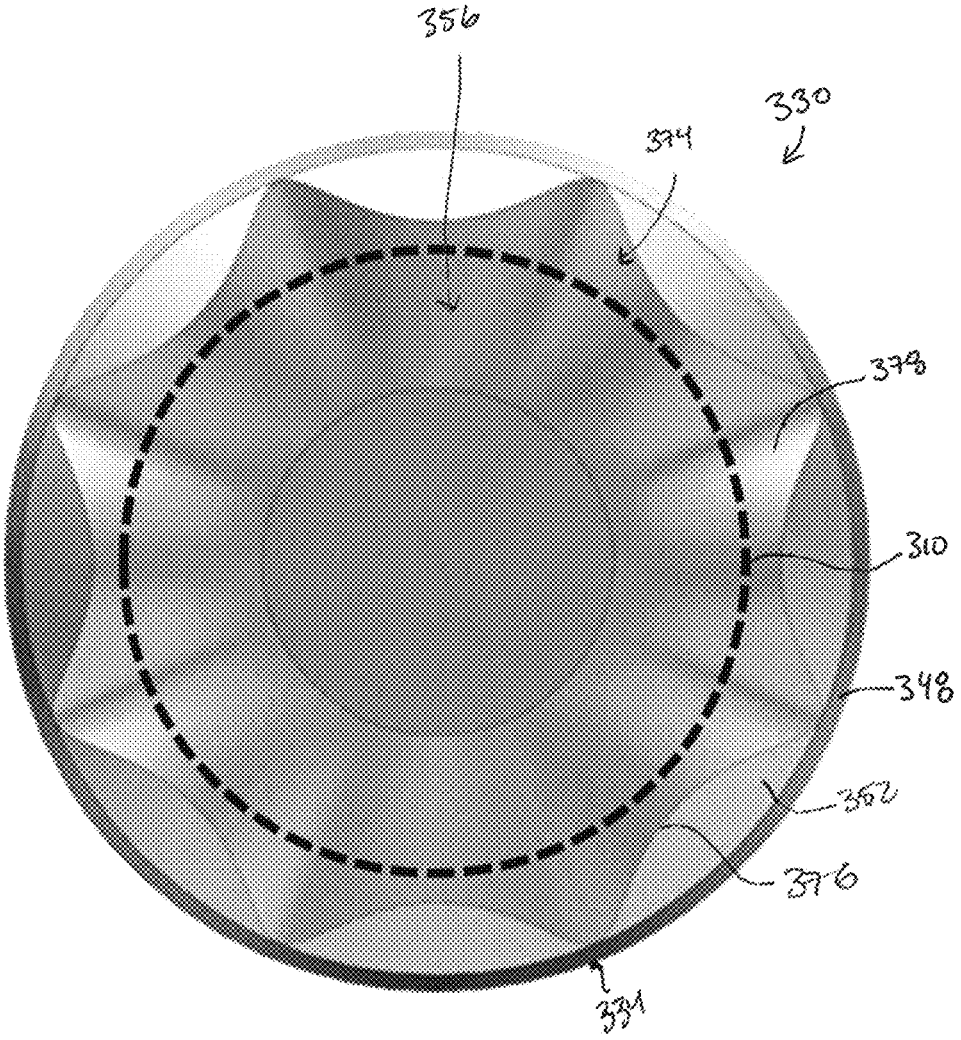
FIG. 7 is a front view of cutting element having at least one recess formed in the surface of the waveform of the polycrystalline, superabrasive material of the cutting element according to additional embodiments of the present disclosure.

FIG. 7 is a front view of cutting element 330 having at least one recess 310 formed in the surface 378 of the waveform 374 of the polycrystalline, superabrasive material 334 of the cutting element 330 according to additional embodiments of the present disclosure. As shown in FIG. 7, the at least one recess 310 may be oriented in circle. In some embodiments, the at least one recess 310 may be continuous. In additional embodiments, the at least one recess 310 may be segmented. Furthermore, the at least one recess 310 may have any of the dimensions discussed above in regard to FIGS. 4-6B. Additionally, the at least one recess 310 may be spaced apart from the outer peripheral edge of the first transition surface 348 or the undulating edge 376 by any of the distances described above in regard to FIGS. 4-6B.

In one or more embodiments, the at least one recess 310 may include a plurality of concentric circles of recesses. Furthermore, one or more of the concentric circles may be continuous, and one or more of the concentric circles may be segmented.

Figure 8:
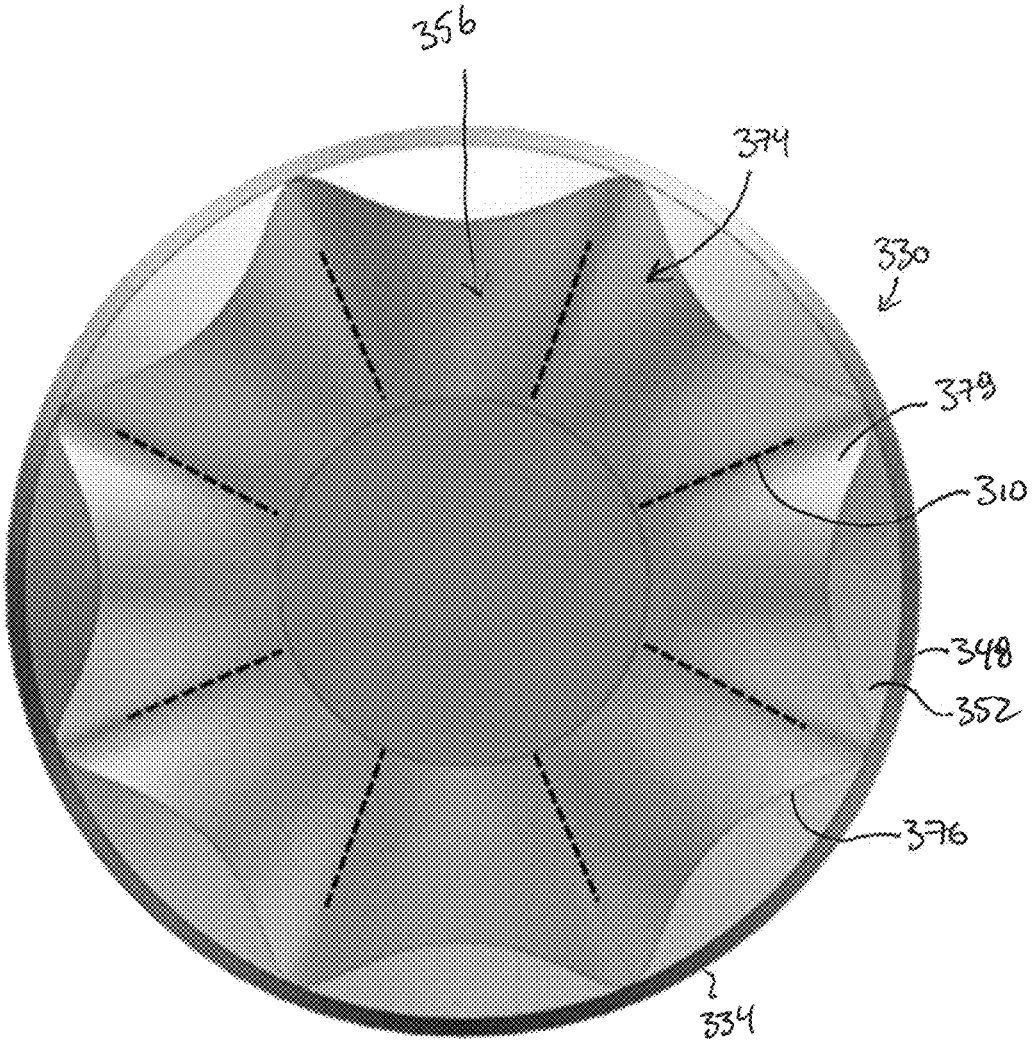
FIG. 8 is a front view of cutting element having at least one recess formed in the surface of the waveform of the polycrystalline, superabrasive material of the cutting element according to additional embodiments of the present disclosure.

FIG. 8 is a front view of cutting element 330 having at least one recess 310 formed in the surface 378 of the waveform 374 of the polycrystalline, superabrasive material 334 of the cutting element 330 according to additional embodiments of the present disclosure. As shown in FIG. 7, the at least one recess 310 may include a plurality of radially extending recesses. The plurality of radially extending recesses may be continuous or segmented and the radially extending recesses may vary from one recess to another.

In some embodiments, each of the radially extending recesses may extend along a trough of the waveform 374 of the stress-reduction feature 356 of the cutting element 330. In additional embodiments, each of the radially extending recesses may extend along a peak of the waveform 374 of the stress-reduction feature 356 of the cutting element 330. In further embodiments, the waveform 374 of the stress-reduction feature 356 may include a radially extending recess in both the troughs and the peaks of the waveform 374 of the stress-reduction feature 356 of the cutting element 330. In some embodiments, the plurality of radially extending recesses may extend beyond the undulating edge 376 and into the first or second transition surface 348, 352 of the cutting element 330. Additionally, the plurality of radially extending recesses may extend into the planar surface 380 of the cutting element 330.

In one or more embodiments, the radially extending recesses may prevent spalls from spreading from one wave into other waves of the waveform 374 of the stress-reduction feature 356 of the cutting element 330. As a result, the radially extending recesses may improve the ability of the cutting element 330 to be rotated (i.e., "spun") about its longitudinal axis within a cutting element pocket of a blade 206 in the earth-boring tool 200 to present an unspalled portion of the polycrystalline, superabrasive material 334 for contact with a formation, as discussed above in regard to FIG. 5. In yet further embodiments, the cutting element 330 may include any of the recess described in U.S. patent application Ser. No. 14/656,036 to Stockey et al., filed Mar. 12, 2015, the disclosure of which is incorporated in its entirety by this reference herein.

Figure 9A:
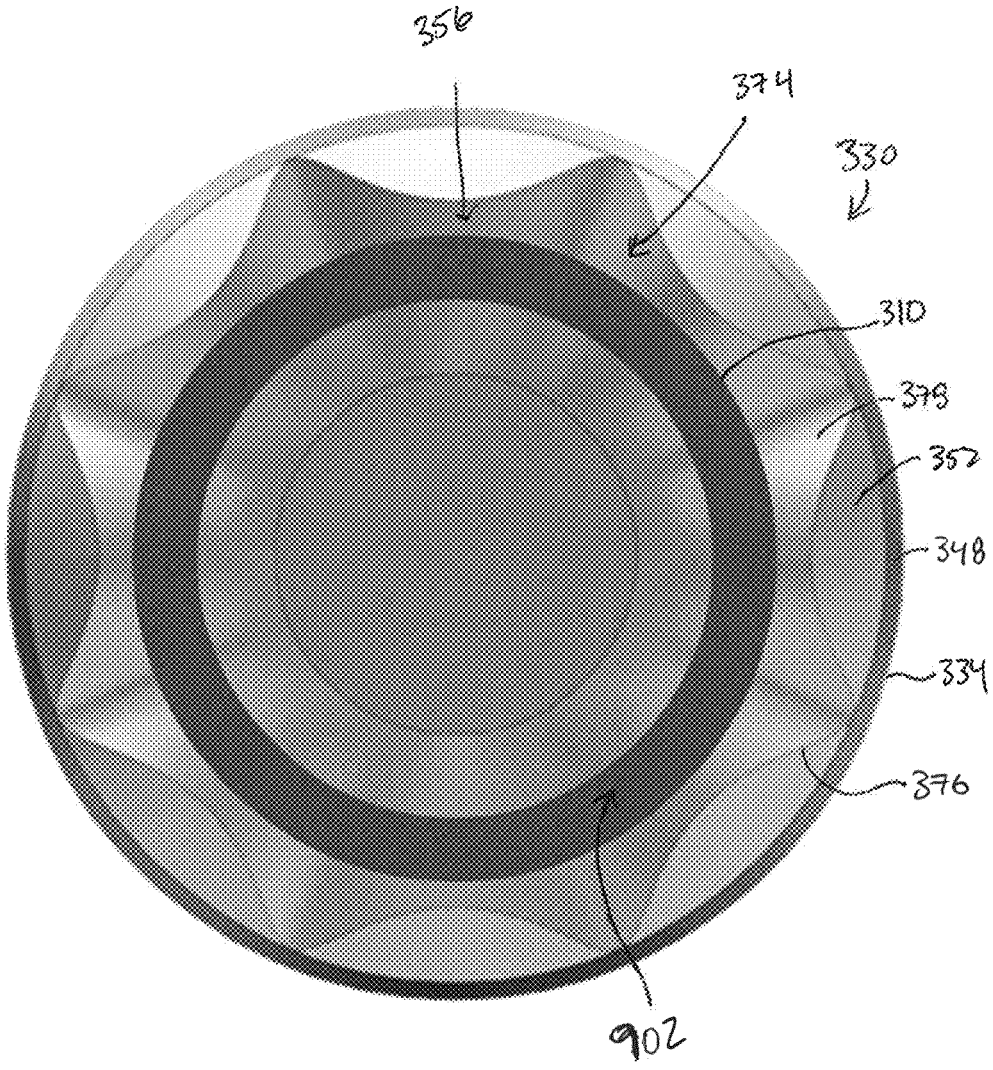
FIGS. 9A and 9B are front views of cutting elements having at least one recess formed in the surface of the waveform of the polycrystalline, superabrasive material of the cutting element according to additional embodiments of the present disclosure.
Figure 9B:
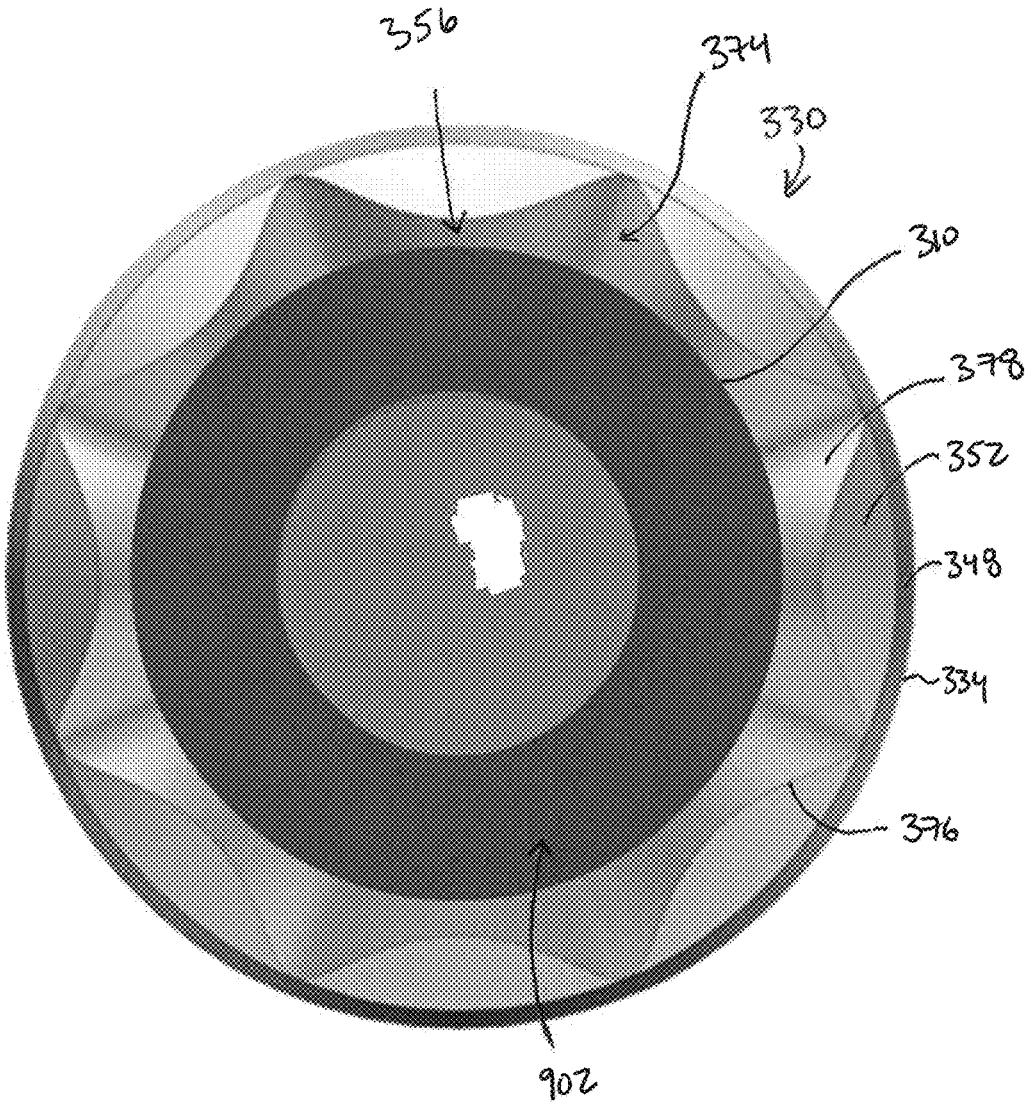

FIGS. 9A and 9B are front views of cutting elements 330 having at least one recess 310 formed in the surface 378 of the waveform 374 of the polycrystalline, superabrasive material 334 of the cutting element 330 according to additional embodiments of the present disclosure. As shown in FIGS. 9A and 9B, in some embodiments, the at least one recess 310 may include a relatively wide recess 902 (referred to herein as a "wide recess") formed the in the surface 378 of the waveform 374 of the polycrystalline, superabrasive material 334 of the cutting element 330. In some embodiments, the wide recess 902 may be segmented or continuous. In one or more embodiments, the wide recess 902 may include a recess formed in a circle. Furthermore, in one or more embodiments, the cutting element 330 may include a plurality of wide recesses forming a plurality of concentric circle recesses. In some embodiments, the wide recess 902 may form a stop in the waveform 374 of the polycrystalline, superabrasive material 334 of the cutting element 330.

The wide recess 902 may have any of the depths and orientations of sidewalls above in regard to FIGS. 5-9B. However, the wide recess 902 may have a width within a range of about 25.0 μm to about 3 mm. For example, the wide recess 902 may have a width within a range of about 100 μm to about 3 mm. As a non-limiting example, the wide recess 902 may have a width within a range of about 1 mm to about 2 mm. The wide recess 902 may provide the same advantages of the at least one recess 310 described above. Additionally, the wide recess 902 of the cutting element 330 may result in smaller cuttings and may prevent any cracks/spalls from propagateing inward toward the center longitudinal axis 350 of the cutting element 330. As a result, the wide recess 902 of the cutting element 330 may maintain a cutting table edge (e.g., cutting edge) longer than conventional cutting elements. Additionally, the wide recess 902 may enable more fluids to travel toward a center of the cutting face 354 and across the cutting face 354 providing for more cooling.

Figure 10:
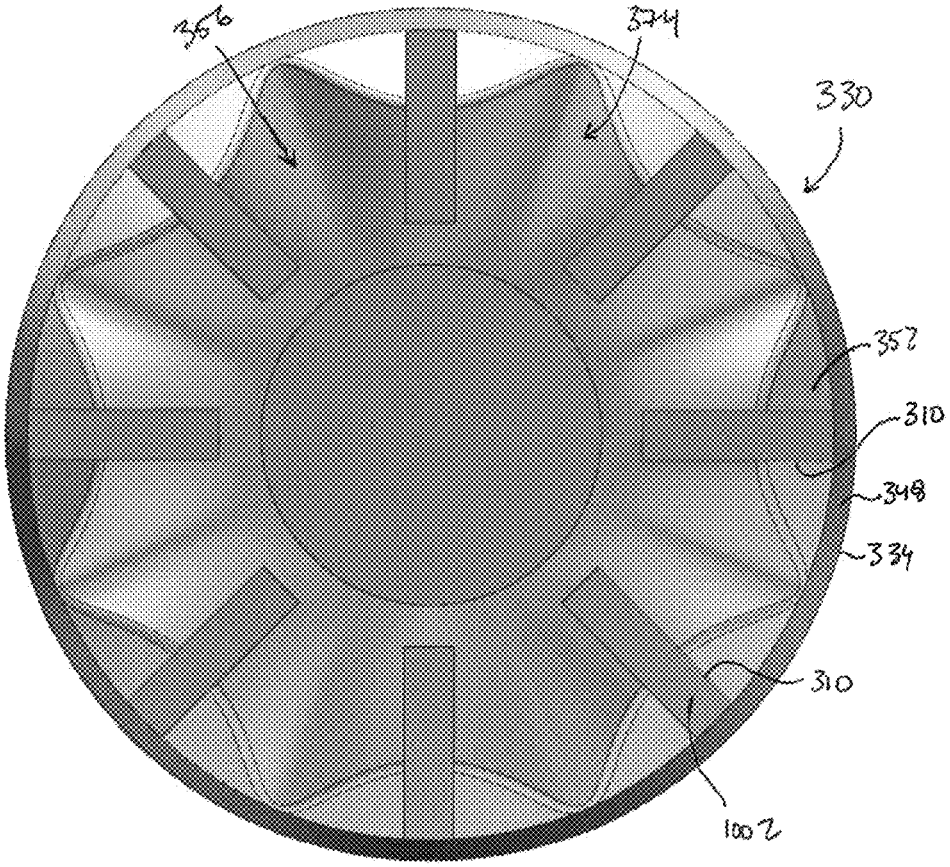
FIG. 10 is a front view of cutting element having at least one recess formed in the surface of the waveform of the polycrystalline, superabrasive material of the cutting element according to additional embodiments of the present disclosure.

FIG. 10 is a front view of cutting element 330 having at least one recess 310 formed in the surface 378 of the waveform 374 of the polycrystalline, superabrasive material 334 of the cutting element 330 according to additional embodiments of the present disclosure. As shown in FIG. 10, in some embodiments, the at least one recess 310 may include a plurality of wide grooves 1002 formed the in the surface 378 of the waveform 374 of the polycrystalline, superabrasive material 334 of the cutting element 330 and extending outward radially. In some embodiments, the plurality of wide grooves 1002 may be segmented or continuous. In one or more embodiments, the plurality of wide grooves 1002 may be formed in the troughs and/or peaks.

In some embodiments, the plurality of wide grooves 1002 may extend from a location proximate to the planar surface 380 of the cutting element 330 to an edge defined between the second transition surface 352 and the first transition surface 348 of the cutting element 330. In additional embodiments, the plurality of wide grooves 1002 may extend from the planar surface 380 of the cutting element 330 to an edge defined between the second transition surface 352 and the first transition surface 348 of the cutting element 330. In additional embodiments, the plurality of wide grooves 1002 may extend into the first transition surface 348 of the cutting element 330. Additionally, in some embodiments, the plurality of wide grooves 1002 may extend to the outer peripheral edge of the first transition surface 348 of the cutting element 330. Additionally, in some embodiments, the plurality of wide grooves 1002 may extend at least partially into the planar surface 380 of the cutting element 330.

Each of the wide grooves 1002 may have a depth within a range of about 50 μm to about 80 μm. For example, each of the wide grooves 1002 may have a width within a range of about 55 μm to about 75 μm. As a non-limiting example, each of the wide grooves 1002 may have a width within a range of about 60 μm to about 70 μm. In some embodiments, the plurality of wide grooves 1002 may have varying depths from groove to groove. In one or more embodiments, one or more grooves of the plurality of wide grooves 1002 may have a varying depth along a length of the one or more grooves. For instance, a depth of a groove of the plurality of wide grooves 1002 may increase or decrease as a radial distance from the center longitudinal axis 350 increases. In some embodiments, base walls of the plurality of wide grooves 1002 may be planar. In additional embodiments, the base walls of the plurality of wide grooves 1002 may at least substantially match a curvature of the waveform 374 where the plurality of wide grooves 1002 are formed. In further embodiments, the base walls of the plurality of wide grooves 1002 may be irregular.

Additionally, each of the wide grooves 1002 may have a width within a range of about 1 mm to about 4 mm. For example, each of the wide grooves 1002 may have a width within a range of about 1.5 mm to about 3.5 mm. As a non-limiting example, each of the wide grooves 1002 may have a width within a range of about 2 mm to about 3 mm. The plurality of wide grooves 1002 may provide the same advantages of the at least one recess 310 described above. Furthermore, the plurality of wide grooves 1002 may reduce friction between a formation (e.g., rock) and the cutting face 354 of the cutting element 330. The wide grooves 1002 may allow more fluid to flow across the cutting face 354 of the cutting element 330 in comparison to conventional cutting element. Additionally, the wide grooves 1002 reduce a contact area between the formation and the cutting face 354 of the cutting element 330 and thereby provides cooling by decreasing friction.

Additional non limiting example embodiments of the disclosure are described below.

Embodiment 1

A cutting element for an earth-boring tool, comprising: a substrate; and a polycrystalline, superabrasive material secured to an end of the substrate, the polycrystalline, superabrasive material comprising a curved, stress-reduction feature formed in a cutting face of the polycrystalline, superabrasive material; at least one recess defined in the curved, stress-reduction feature of the polycrystalline, superabrasive material and comprising: sidewalls intersecting with a front surface of the curved, stress-reduction feature of the polycrystalline, superabrasive material and extending to a base wall within the polycrystalline, superabrasive material.

Embodiment 2

The cutting element of embodiment 1, wherein the cutting element further comprises a first transition surface extending from an outer peripheral edge of the polycrystalline, superabrasive material and in a first direction oblique to a center longitudinal axis of the substrate, and wherein the curved, stress-reduction feature is formed at least partially on the first transition surface.

Embodiment 3

The cutting element of embodiments 1 and 2, wherein the curved, stress-reduction feature comprises: an undulating edge formed proximate a peripheral edge of the polycrystalline, superabrasive material; and a waveform extending from the undulating edge toward a center longitudinal axis of the cutting element.

Embodiment 4

The cutting element of embodiments 1-3, wherein the at least one recess is concentric with the undulating edge.

Embodiment 5

The cutting element of embodiments 1-3, wherein the at least one recess forms a circle in the waveform of the curved, stress-reduction feature, and wherein the at least one recess is concentric with an outer peripheral edge of the polycrystalline, superabrasive material.

Embodiment 6

The cutting element of embodiments 1-3, wherein the at least one recess comprises a plurality of wide grooves extending outward radially relative to the center longitudinal axis of the cutting element.

Embodiment 7

The cutting element of embodiment 6, wherein the plurality of wide grooves at formed in peaks of waves of the waveform of the curved, stress-reduction feature.

Embodiment 8

The cutting element of embodiments 1-3, wherein the at least one recess comprises a plurality of grooves extending outward radially relative to the center longitudinal axis of the cutting element and formed within troughs of waves of the waveform of the curved, stress-reduction feature.

Embodiment 9

The cutting element of embodiments 1-8, wherein an intersection of a sidewall of the at least one recess and the front surface of the curved, stress-reduction feature most proximate an outer peripheral edge of the polycrystalline, superabrasive material is located a distance of 0.5 mm to 4.0 mm from the outer peripheral edge of the polycrystalline, superabrasive material and wherein the at least one recess has a width within a range of 25.0 μm to 650 μm and a depth within a range of 25.0 μm to 600 μm.

Embodiment 10

An earth-boring tool, comprising: a body; and a cutting element secured to the body, the cutting element comprising: a substrate; and a polycrystalline, superabrasive material secured to an end of the substrate, the polycrystalline, superabrasive material comprising a curved, stress-reduction feature formed in a cutting face of the polycrystalline, superabrasive material, the curved, stress-reduction feature comprising: an undulating edge formed proximate an outer peripheral edge of the polycrystalline, superabrasive material; and a waveform extending from the undulating edge toward a center longitudinal axis of the cutting element; and at least one recess defined in the waveform of the curved, stress-reduction feature of the polycrystalline, superabrasive material and comprising: sidewalls intersecting with a front surface of the waveform of the curved, stress-reduction feature of the polycrystalline, superabrasive material and extending to a base wall within the polycrystalline, superabrasive material.

Embodiment 11

The cutting element of embodiment 10, wherein an intersection of a sidewall of the at least one recess and the front surface of the waveform of the curved, stress-reduction feature most proximate the outer peripheral edge of the polycrystalline, superabrasive material is located a distance of 0.5 mm to 4.0 mm from the outer peripheral edge of the polycrystalline, superabrasive material and wherein the at least one recess has a width within a range of 25.0 μm to 650 μm and a depth within a range of 25.0 μm to 600 μm.

Embodiment 12

The cutting element of embodiments 10 and 11, wherein the cutting element further comprises a first transition surface extending from the outer peripheral edge of the polycrystalline, superabrasive material and in a first direction oblique to the center longitudinal axis of the substrate, and wherein the curved, stress-reduction feature is formed at least partially on the first transition surface.

Embodiment 13

The cutting element of embodiment 12, further comprising a second transition surface extending from the first transition surface and in a second direction oblique to the center longitudinal axis, the second direction being different from the first direction.

Embodiment 14

The cutting element of embodiments 10-13, wherein the at least one recess is concentric with the undulating edge.

Embodiment 15

The cutting element of embodiments 10-13, wherein the at least one recess forms a circle in the front surface of the waveform of the curved, stress-reduction feature, and wherein the at least one recess is concentric with the outer peripheral edge of the polycrystalline, superabrasive material.

Embodiment 16

The cutting element of embodiments 10-13, wherein the at least one recess comprises a plurality of recesses grooves extending outward radially relative to the center longitudinal axis of the cutting element and formed within troughs of waves of the waveform of the curved, stress-reduction feature.

Embodiment 17

A method of forming a cutting element for an earth-boring tool, the method comprising: attaching a polycrystalline, superabrasive material to a substrate; forming a curved, stress-reduction feature in a cutting face of the polycrystalline, superabrasive material, the curved, stress-reduction feature comprising: an undulating edge formed proximate an outer peripheral edge of the polycrystalline, superabrasive material; and a waveform extending from the undulating edge toward a center longitudinal axis of the substrate; and forming at least one recess in the curved, stress-reduction feature of the polycrystalline, superabrasive material, the at least one recess comprising: sidewalls intersecting with a front surface of the curved, stress-reduction feature of the polycrystalline, superabrasive material and extending to a base wall within the polycrystalline, superabrasive material.

Embodiment 18

The method of embodiment 17, wherein forming the at least one recess comprises forming the at least on recess to be concentric with the outer peripheral edge of the polycrystalline, superabrasive material.

Embodiment 19

The method of embodiment 17, wherein forming the at least one recess comprises forming the at least on recess to be concentric with the undulating edge of the curved, stress-reduction feature.

Embodiment 20

The method of embodiment 17, wherein forming the at least one recess comprises forming the at least on recess to include a plurality of grooves extending outward radially relative to the center longitudinal axis of the cutting element and formed within troughs of waves of the waveform of the curved, stress-reduction feature.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as claimed, including legal equivalents thereof. In addition, features from one embodiment may be combined with features of another embodiment while still being encompassed within the scope of the invention as contemplated by the inventors. Further, embodiments of the disclosure have utility with different and various tool types and configurations.

What is claimed is:

1. A cutting element for an earth-boring tool, comprising:
- a substrate;
- a polycrystalline, superabrasive material secured to an end of the substrate, the polycrystalline, superabrasive material comprising a curved, stress-reduction feature formed in a cutting face of the polycrystalline, superabrasive material;
- a first transition surface extending from an outer peripheral edge of the polycrystalline, superabrasive material and in a first direction oblique to a center longitudinal axis of the substrate, wherein the curved, stress-reduction feature is formed partially on the first transition surface; and
- at least one recess defined in the curved, stress-reduction feature of the polycrystalline, superabrasive material and comprising: sidewalls intersecting with a front surface of the curved, stress-reduction feature of the polycrystalline, superabrasive material and extending to a base wall within the polycrystalline, superabrasive material.

2. The cutting element of claim 1, wherein the curved, stress-reduction feature comprises:
- an undulating edge formed proximate a peripheral edge of the polycrystalline, superabrasive material; and
- a waveform extending from the undulating edge toward a center longitudinal axis of the cutting element.

3. The cutting element of claim 2, wherein the at least one recess is concentric with the undulating edge.

4. The cutting element of claim 2, wherein the at least one recess forms a circle in the waveform of the curved, stress-reduction feature, and wherein the at least one recess is concentric with an outer peripheral edge of the polycrystalline, superabrasive material.

5. The cutting element of claim 2, wherein the at least one recess comprises a plurality of wide grooves extending outward radially relative to the center longitudinal axis of the cutting element.

6. The cutting element of claim 5, wherein the plurality of wide grooves at formed in peaks of waves of the waveform of the curved, stress-reduction feature.

7. The cutting element of claim 2, wherein the at least one recess comprises a plurality of grooves extending outward radially relative to the center longitudinal axis of the cutting element and formed within troughs of waves of the waveform of the curved, stress-reduction feature.

8. The cutting element of claim 1, wherein an intersection of a sidewall of the at least one recess and the front surface of the curved, stress-reduction feature most proximate an outer peripheral edge of the polycrystalline, superabrasive material is located a distance of 0.5 mm to 4.0 mm from the outer peripheral edge of the polycrystalline, superabrasive material and wherein the at least one recess has a width within a range of 25.0 μm to 650 μm and a depth within a range of 25.0 μm to 600 μm.

9. An earth-boring tool, comprising:
- a body; and
- a cutting element secured to the body, the cutting element comprising:
  - a substrate;
  - a polycrystalline, superabrasive material secured to an end of the substrate, the polycrystalline, superabrasive material comprising a curved, stress-reduction feature formed in a cutting face of the polycrystalline, superabrasive material, the curved, stress-reduction feature comprising:
    - an undulating edge formed proximate an outer peripheral edge of the polycrystalline, superabrasive material; and
    - a waveform extending from the undulating edge toward a center longitudinal axis of the cutting element;
  - a first transition surface extending from an outer peripheral edge of the polycrystalline, superabrasive material and in a first direction oblique to a center longitudinal axis of the substrate, wherein the curved, stress-reduction feature is formed partially on the first transition surface; and
  - at least one recess defined in the waveform of the curved, stress-reduction feature of the polycrystalline, superabrasive material and comprising: sidewalls intersecting with a front surface of the waveform of the curved, stress-reduction feature of the polycrystalline, superabrasive material and extending to a base wall within the polycrystalline, superabrasive material.

10. The cutting element of claim 9, wherein an intersection of a sidewall of the at least one recess and the front surface of the waveform of the curved, stress-reduction feature most proximate the outer peripheral edge of the polycrystalline, superabrasive material is located a distance of 0.5 mm to 4.0 mm from the outer peripheral edge of the polycrystalline, superabrasive material and wherein the at least one recess has a width within a range of 25.0 μm to 650 μm and a depth within a range of 25.0 μm to 600 μm.

11. The cutting element of claim 9, further comprising a second transition surface extending from the first transition surface and in a second direction oblique to the center longitudinal axis, the second direction being different from the first direction.

12. The cutting element of claim 9, wherein the at least one recess is concentric with the undulating edge.

13. The cutting element of claim 9, wherein the at least one recess forms a circle in the front surface of the waveform of the curved, stress-reduction feature, and wherein the at least one recess is concentric with the outer peripheral edge of the polycrystalline, superabrasive material.

14. The cutting element of claim 9, wherein the at least one recess comprises a plurality of grooves extending outward radially relative to the center longitudinal axis of the cutting element and formed within troughs of waves of the waveform of the curved, stress-reduction feature.

15. A method of forming a cutting element for an earth-boring tool, the method comprising:

attaching a polycrystalline, superabrasive material to a substrate;

forming a first transition surface extending from an outer peripheral edge of the polycrystalline, superabrasive material and in a first direction oblique to a center longitudinal axis of the substrate;

forming a curved, stress-reduction feature in a cutting face of the polycrystalline, superabrasive material and partially on the first transition surface, the curved, stress-reduction feature comprising:

an undulating edge formed proximate an outer peripheral edge of the polycrystalline, superabrasive material; and a waveform extending from the undulating edge toward a center longitudinal axis of the substrate; and forming at least one recess in the curved, stress-reduction feature of the polycrystalline, superabrasive material, the at least one recess comprising: sidewalls intersecting with a front surface of the curved, stress-reduction feature of the polycrystalline, superabrasive material and extending to a base wall within the polycrystalline, superabrasive material.

16. The method of claim 15, wherein forming the at least one recess comprises forming the at least one recess to be concentric with the outer peripheral edge of the polycrystalline, superabrasive material.

17. The method of claim 15, wherein forming the at least one recess comprises forming the at least one recess to be concentric with the undulating edge of the curved, stress-reduction feature.

18. The method of claim 15, wherein forming the at least one recess comprises forming the at least one recess to include a plurality of recesses grooves extending outward radially relative to the center longitudinal axis of the cutting element and formed within troughs of waves of the waveform of the curved, stress-reduction feature.

* * * * *